US005966555A

United States Patent [19]

Nakajima et al.

[11] Patent Number: 5,966,555

[45] Date of Patent: Oct. 12, 1999

[54] IMAGE FORMING APPARATUS PERMITTING WHETHER OR NOT INPUT IMAGE CAN BE FORMED AS DESIRED TO BE KNOWN

[75] Inventors: Akio Nakajima; Keiji Kusumoto; Syuji Maruta, all of Toyokawa; Yoshikazu Ikenoue, Toyohashi, all of Japan

[73] Assignee: Minolta Co., Ltd., Osaka, Japan

[21] Appl. No.: 08/974,730

[22] Filed: Nov. 19, 1997

[30] Foreign Application Priority Data

Nov. 20, 1996 [JP] Japan ..... 8-309283
Dec. 20, 1996 [JP] Japan ..... 8-342135

[51] Int. Cl.[6] ..... G03G 15/00

[52] U.S. Cl. ..... 399/18; 358/296; 399/23; 399/27

[58] Field of Search ..... 399/9, 14, 23, 399/24, 27, 35, 43, 81, 18; 358/401, 296

[56] References Cited

U.S. PATENT DOCUMENTS

| | | | |
|---|---|---|---|
| 4,511,243 | 4/1985 | Smith . | |
| 4,627,715 | 12/1986 | Kikuno | 399/27 |
| 4,677,310 | 6/1987 | Midorikawa et al. | 307/64 |
| 4,734,747 | 3/1988 | Okuda et al. | 399/23 |
| 5,021,826 | 6/1991 | Maruta | 399/24 |
| 5,036,361 | 7/1991 | Filion et al. . | |
| 5,095,331 | 3/1992 | Takano | 399/63 |
| 5,253,077 | 10/1993 | Hasegawa et al. . | |
| 5,636,032 | 6/1997 | Springett | 358/296 |
| 5,802,420 | 9/1998 | Garr et al. | 399/27 |

FOREIGN PATENT DOCUMENTS

| | | |
|---|---|---|
| 57-070553 | 5/1982 | Japan . |
| 61-295579 | 12/1986 | Japan . |
| 3-85557 | 4/1991 | Japan . |
| 04029160 | 1/1992 | Japan . |

*Primary Examiner*—Joan Pendegrass
*Attorney, Agent, or Firm*—McDermott, Will & Emery

[57] ABSTRACT

A digital copying machine as an example of an image forming apparatus sets a copying operation time period per sheet based on the size of a copying sheet. If the remaining number of sheets corresponding to an expendable in the digital copying machine decreases, time at which this expandable runs out is displayed, and time at which a discharge tray is filled is displayed if the number of sheets to be discharged onto the discharge tray is expected to exceed a fixed value. As a result, an image forming apparatus permitting an operator to smoothly perform processings with the apparatus if a copying operation to a set of documents formed of a plurality of sheets cannot be completed.

7 Claims, 38 Drawing Sheets

MT1

| REGION | PAGE NUMBER PN | FORWARD CONCATENATION | REWARD CONCATENATION | ADDITIONAL INFORMATION |
|---|---|---|---|---|
| 00 | 1 | 00 | 01 | |
| 01 | 1 | 01 | FF | |
| 02 | 2 | 00 | 03 | |
| 03 | 2 | 03 | FF | |
| ⋮ | | | | |

IMAGE FORMING APPARATUS PERMITTING WHETHER OR NOT INPUT IMAGE CAN BE FORMED AS DESIRED TO BE KNOWN

BACKGROUND OF THE INVENTION

1. Field of the Invention

The present invention relates generally to image forming apparatuses, and more particularly, to an image forming apparatus which permits a user to determine whether desired image formation can be achieved when the user sets a set of documents.

2. Description of the Related Art

There has been known an image forming apparatus capable of making time display associated with image forming processing, such as an apparatus disclosed by Japanese Patent Laying-Open No. 57-70553. Since the image forming apparatus can display the time when a copying operation for a set of a plurality of documents is completed, the user may confirm the display, then leave the image forming apparatus and return around the time of the completion of the set copying operation. More specifically, the user can make effective use of the time period until 1 the copying operation by the image forming apparatus completes.

The above-described image forming apparatus, though displays the time of the completion of a copying operation, does not take into account such a case in which the operation of the image forming apparatus is interrupted because of some error before the completion time, and the set copying operation cannot be completed as a result.

If, for example, the user is away from the image forming apparatus after a copying operation is initiated, and a paper empty state is attained before the displayed completion time, the copying operation will not have been completed when the user returns to the image forming apparatus at the displayed completion time.

Meanwhile, there is known an image forming apparatus including a memory for storing image data which reads all the data of a set of documents and then starts printing. For example, an apparatus disclosed by U.S. Pat. No. 5,253,077 reads documents while storing the image data into its memory, and at the same time sequentially reads out data stored in the memory while printing the data.

In such an image forming apparatus, once a document is read and stored in the memory, the operator can leave the apparatus with the document as soon as the document has been read (if a printing operation thereof is not completed), because the printing operation is performed based on the image data stored in the memory.

In this case, during printing, sheets of paper set in a paper feeding cassette are sequentially fed for printing. A known apparatus is provided with another paper feeding cassette accommodating paper sheets of the same size, direction and attribute as the other cassette to cope with the case in which the other paper feeding cassette runs out of paper sheets (hereinafter the case will be referred to as "paper empty"), and continues an ongoing printing operation by switching between the paper feeding cassettes, so that more sheets of paper than the volume of each paper feeding cassette is available.

In some recent image forming apparatuses, the power supply is automatically turned off after the apparatus is left not operated for a prescribed time period, in other words measures to cope with the energy restriction is taken.

Although the above-described image forming apparatuses are provided with a number of paper feeding cassettes and switch between the cassettes in response to paper empty, there is still the possibility of paper empty if a large volume of copies are to be made. In particular, if the user leaves the apparatus with documents as soon as the documents have been read, the operator are usually not aware of paper empty if any.

In addition, if the operator is not aware of paper empty for a long period of time, and no operation is performed, the power supply of the image forming apparatus is automatically cut off to cope with the energy restriction, and data read and stored in the memory will be erased. Therefore, the same documents should be again read for storage, resulting in poor operability.

In this case, there may be a resuming function to hold data stored in the memory, and return the data to the memory once the power supply is again turned on after the interruption, but another power supply should be separately provided, which considerably increases the cost. Furthermore, the duration of keeping the data "resumable" is limited.

Some facsimile having an intercepting function performs memory intercepting, in other words allows data to be stored in a memory outside the apparatus if the facsimile on the receiving side is in the state of paper empty. There are other apparatuses which output data to another predetermined facsimile if the facsimile the data is destined for is in a busy state.

The method of simply allowing data to be stored in a memory outside the apparatus cannot solve the problem of the destruction of the content of a job when the power supply off mode is entered. The method of outputting data to a facsimile at another location necessitates the user to move to that location in every such case. In addition, the facsimile of the destination and the intercepting facsimile both should be maintained, which is cumbersome.

SUMMARY OF THE INVENTION

It is therefore an object of the invention to provide an image forming apparatus which permits the user to know if an input job can be completed as planned.

Another object of the invention is to display the time when image formation becomes no longer possible in an image forming apparatus.

Yet another object of the invention is to provide an image forming apparatus capable of notifying the operator of paper empty when an document is read.

A still further object of the invention is to provide an image forming apparatus capable of delaying the timing of occurrence of paper empty.

The above-described objects of the invention may be achieved by an image forming apparatus including the following elements. More specifically, the image forming apparatus according to the invention includes a sensor for determining the state of consumption of image forming elements to form an image, an operation unit for operating the time when an image cannot be formed any longer, based on the state of consumption of the image forming elements, and a display for displaying information related to the time obtained by the operation unit.

Based on the determined consumption state of the image forming elements, the time when an image can no longer be formed is operated and displayed. Thus, the operator can know the time when an image can no longer be formed and whether or not an input job can be completed as planned.

Preferably, the sensor determines the consumption state based on the remaining amount of toner, i.e., an image forming element and on the amount of toner required for an image forming operation for a sheet, and the operation unit operates image forming time for a particular number of copies which makes image formation impossible, based on the consumption state.

The consumption state is determined based on the remaining amount of toner and the amount of toner required for an image formation operation for one sheet, and the time is operated until formation is impossible. Thus, the operator can know when the apparatus runs out of toner and an image can no longer be formed.

According to another aspect of the invention, an image forming apparatus includes an output unit for performing a job to output a paper sheet with a formed image thereon, a sensor for detecting the number of remaining accommodated sheets of paper, a necessary sheet number calculation unit for calculating the number of paper sheets necessary until output of a job is completed, a comparator for comparing the number of sheets calculated by the necessary sheet number calculation unit and the remaining number of sheets detected by the sensor, and an alarm for notifying the user of an expected shortage of sheets when the remaining number of sheets is smaller than the necessary number of sheets.

If the remaining number of sheets is determined smaller than the number of necessary sheets, the user is notified of the information that the formation of the input image cannot be performed because of possible paper empty. As a result, the image forming apparatus can notify the user of the occurrence of paper empty when a set of documents have been read.

According to yet another aspect of the invention, an image forming apparatus includes an output unit for performing a job to output a sheet with a formed image thereon, a sensor for detecting the remaining number of accommodated sheets, a necessary sheet number calculation unit for calculating the necessary number of sheets until output of a job is completed, a comparator for comparing the number of sheets calculated by the necessary sheet number calculation unit and the remaining number of sheets detected by the sensor, and a controller to slow down the speed of outputting sheets by the output unit when the remaining number of sheets is smaller than the necessary number of sheets.

When the remaining number of sheets is determined smaller than the necessary number of sheets, the speed of outputting the sheets is lowered. As a result, an image forming apparatus capable of delaying the timing of occurrence of paper empty can be provided.

The foregoing and other objects, features, aspects and advantages of the present invention will become more apparent from the following detailed description of the present invention when taken in conjunction with the accompanying drawings.

Figure 27:
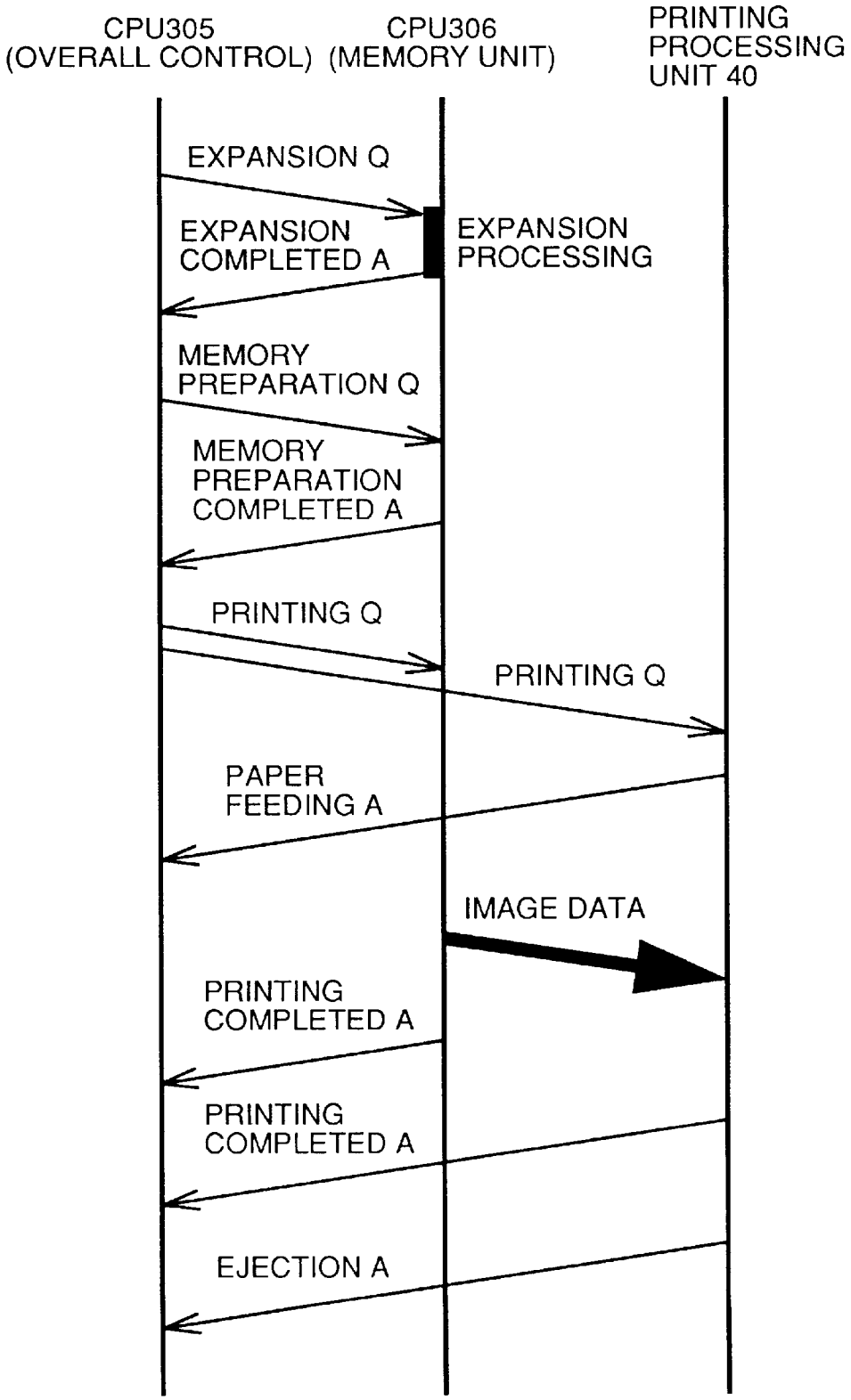
Figure 28:
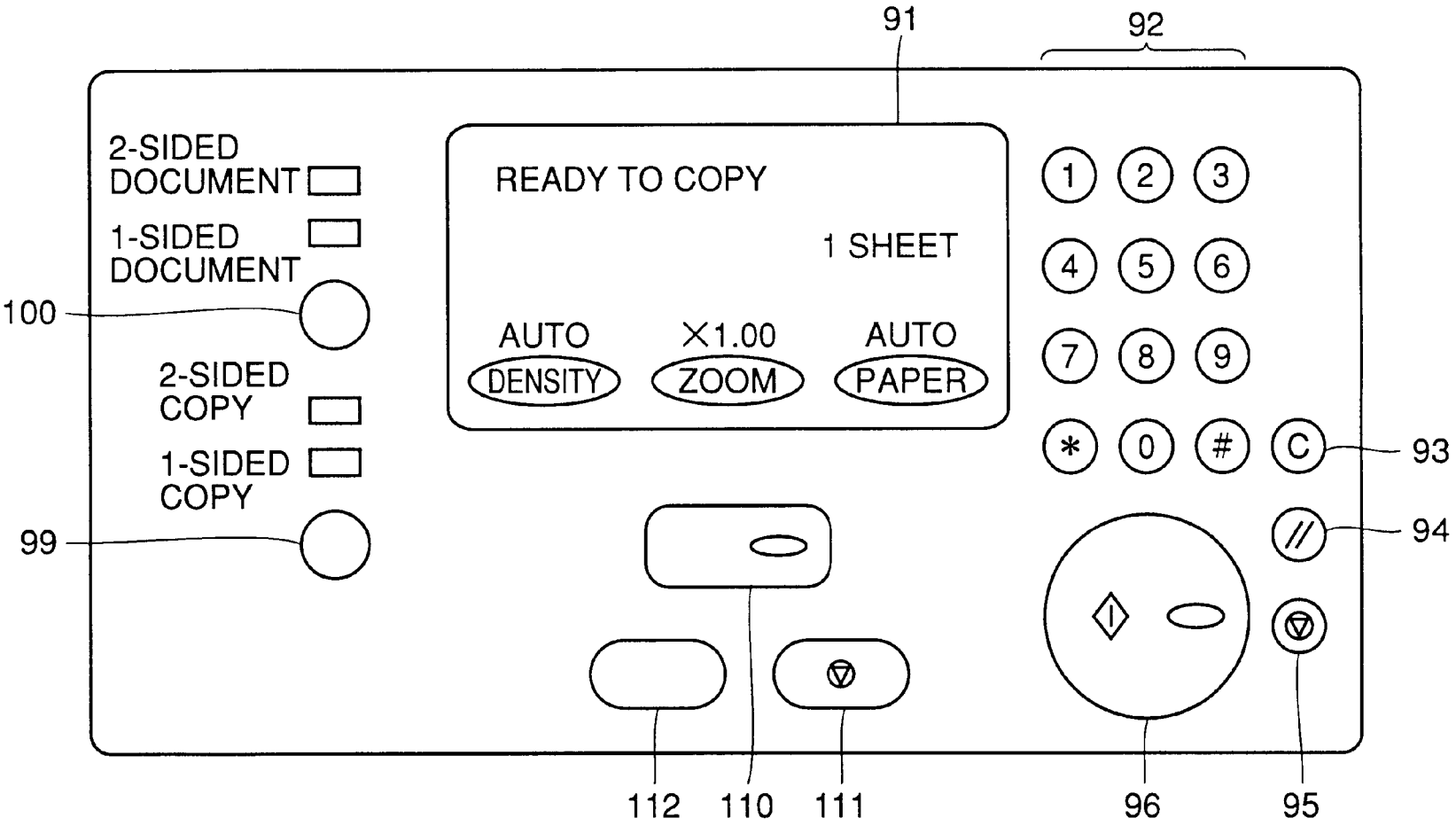
Figure 33:
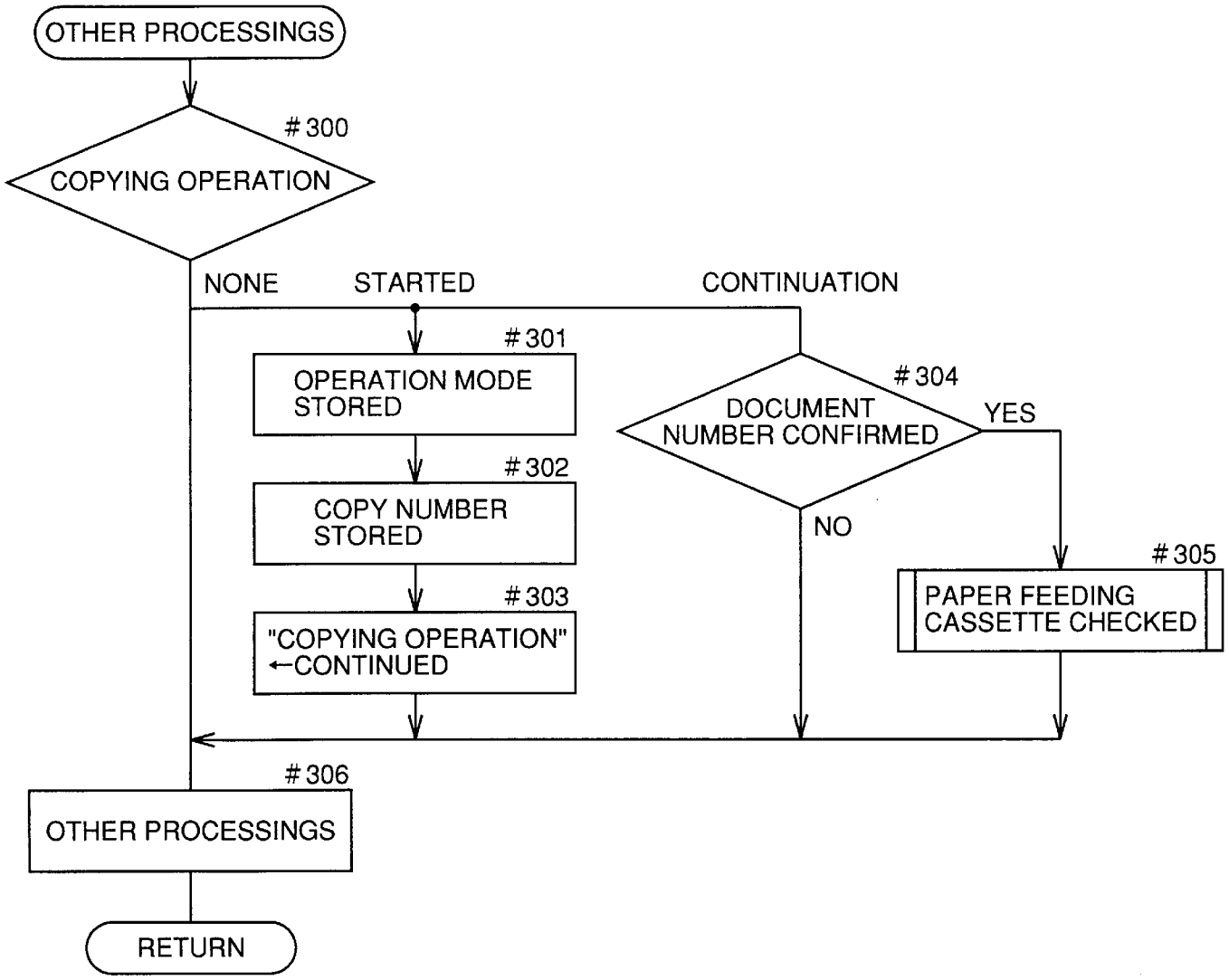
Figure 34:
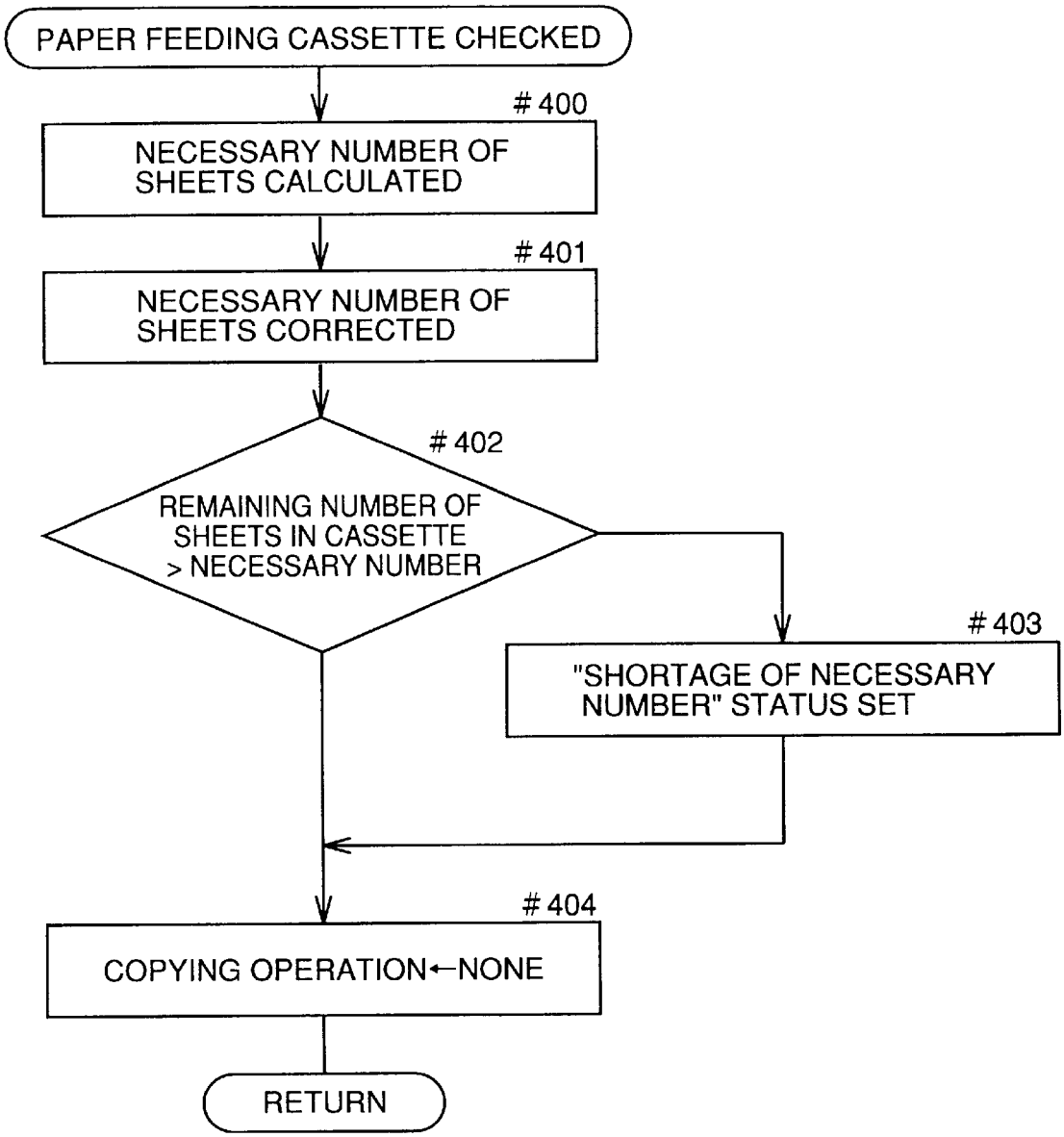
Figure 35:
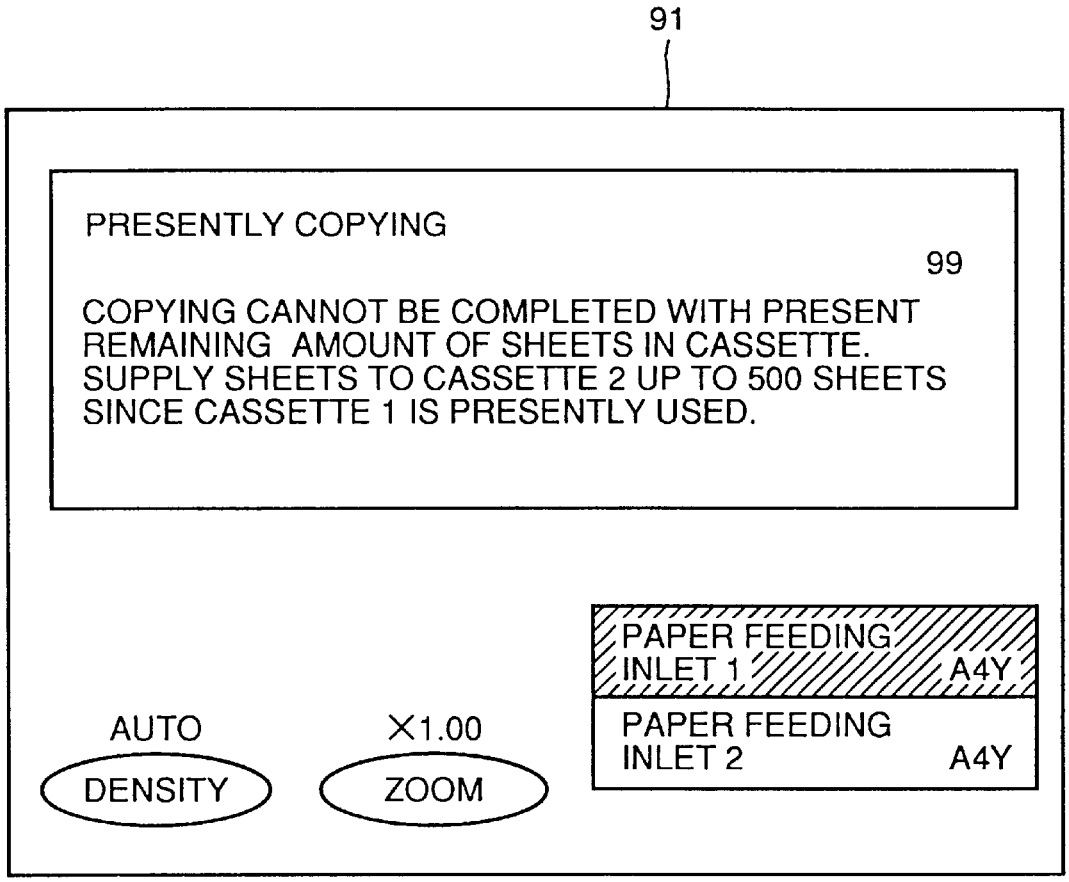
Figure 36:
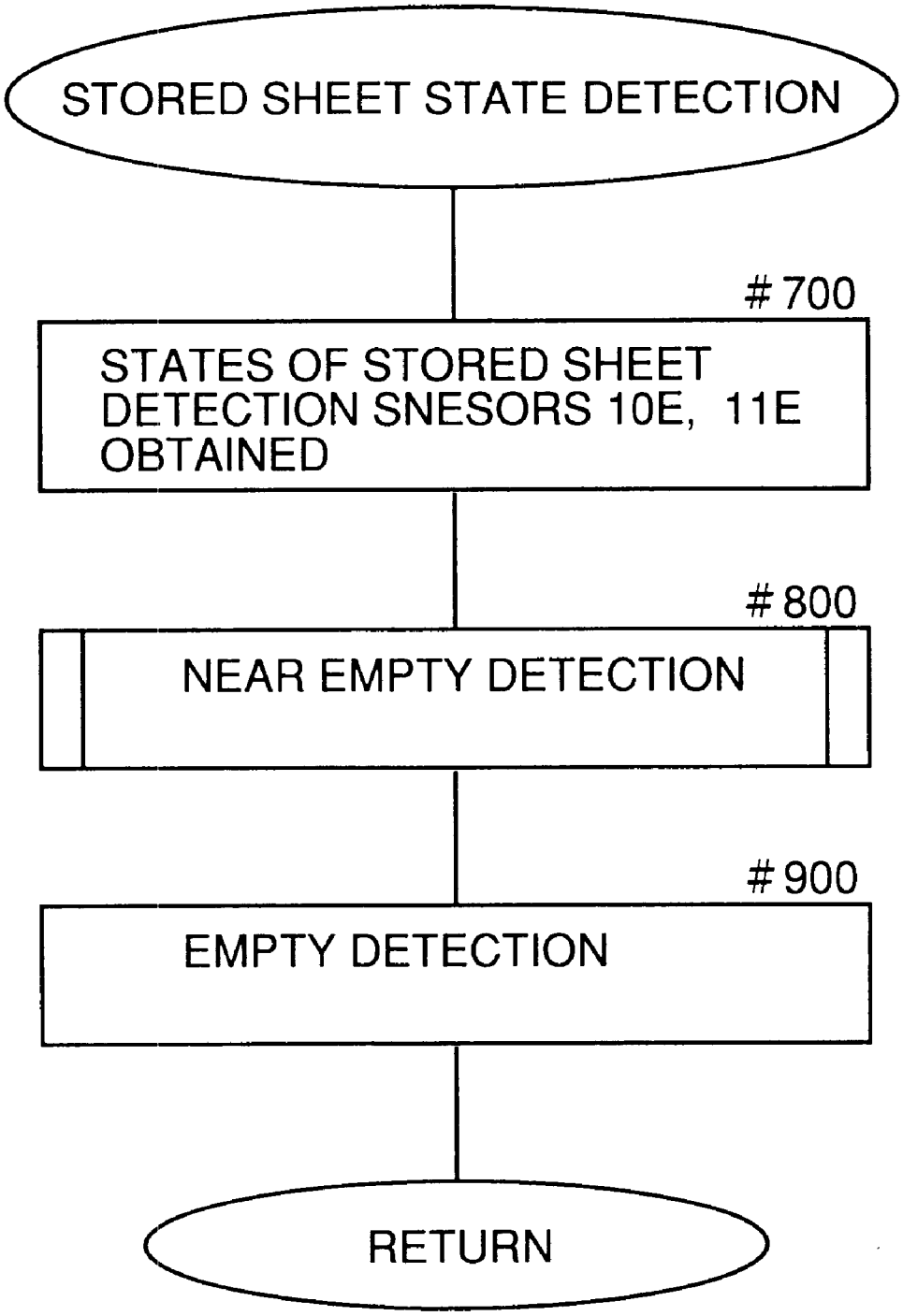
Figure 37:
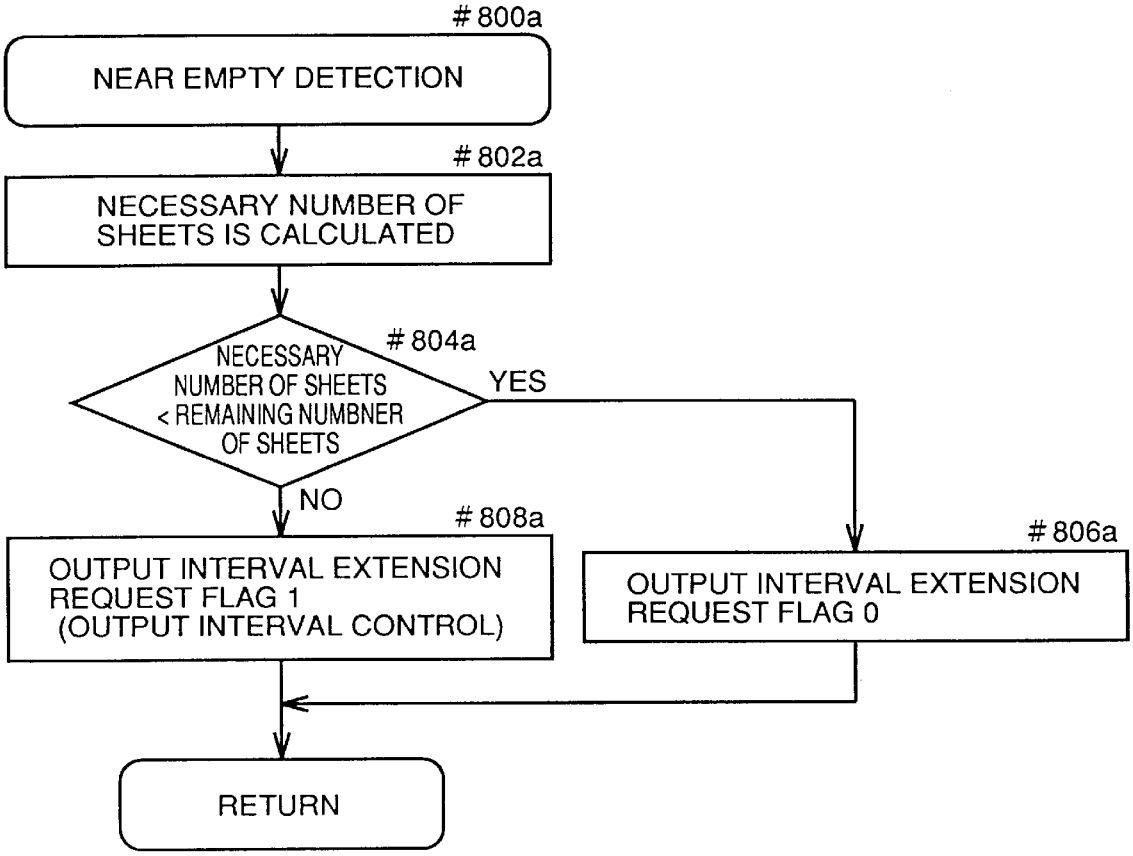
Figure 38:
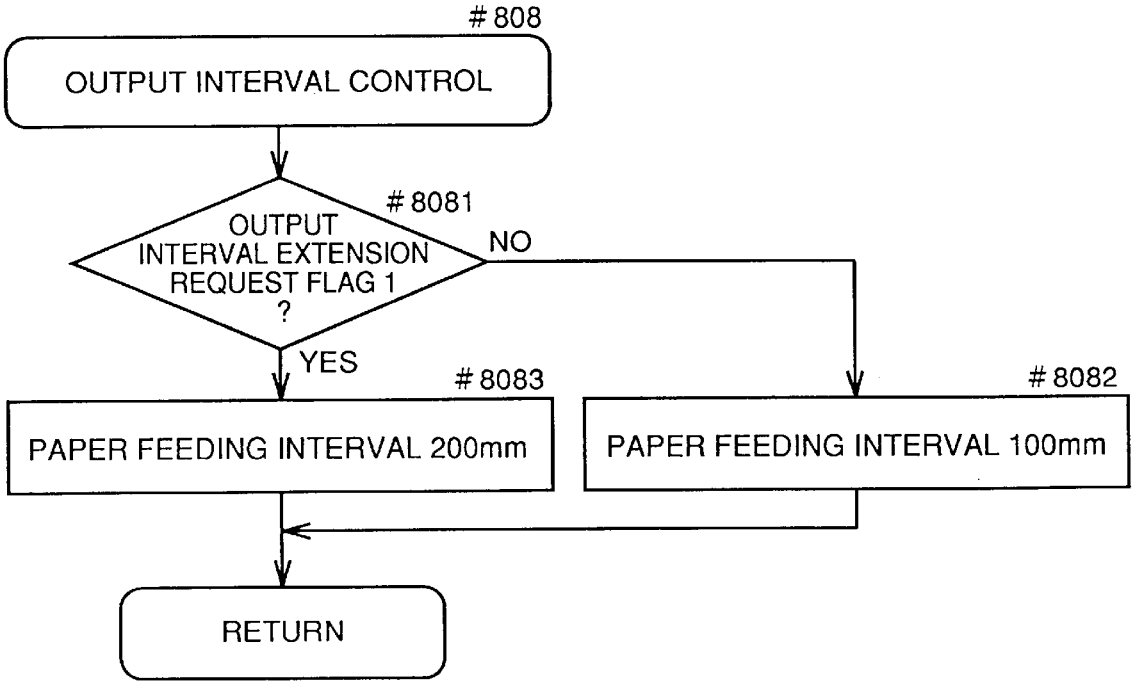
Figure 39:
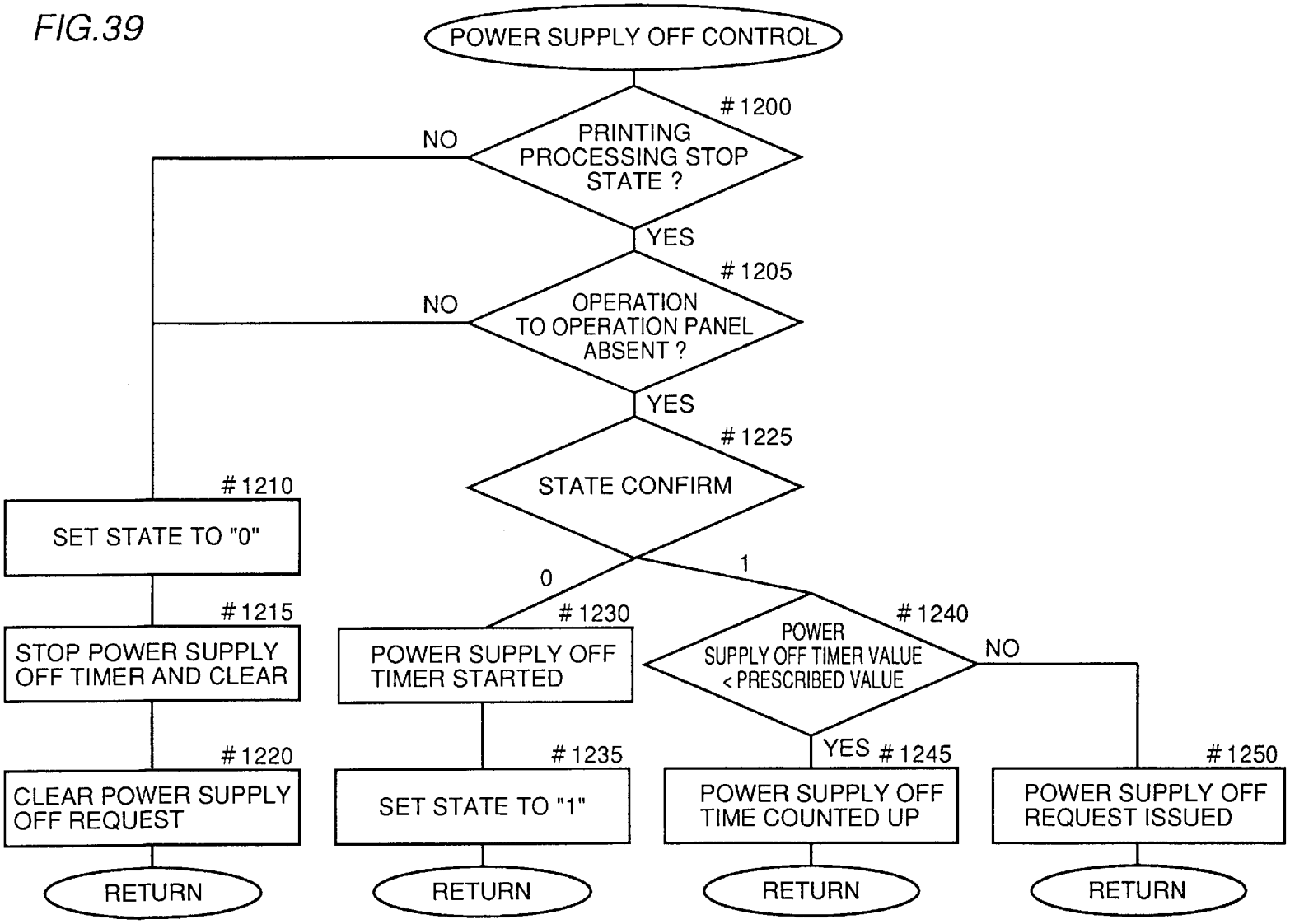
Figure 40:
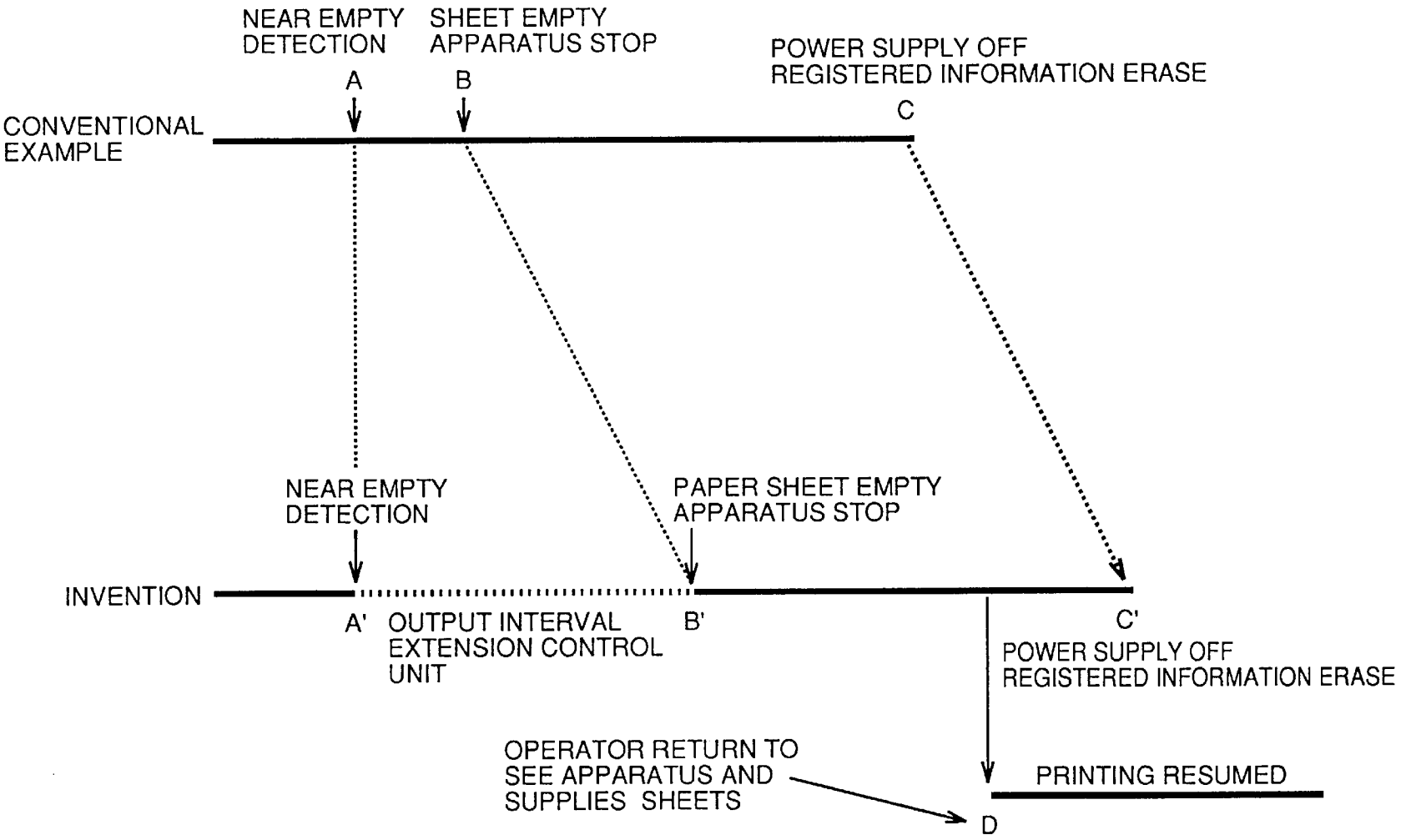
Figure 41:
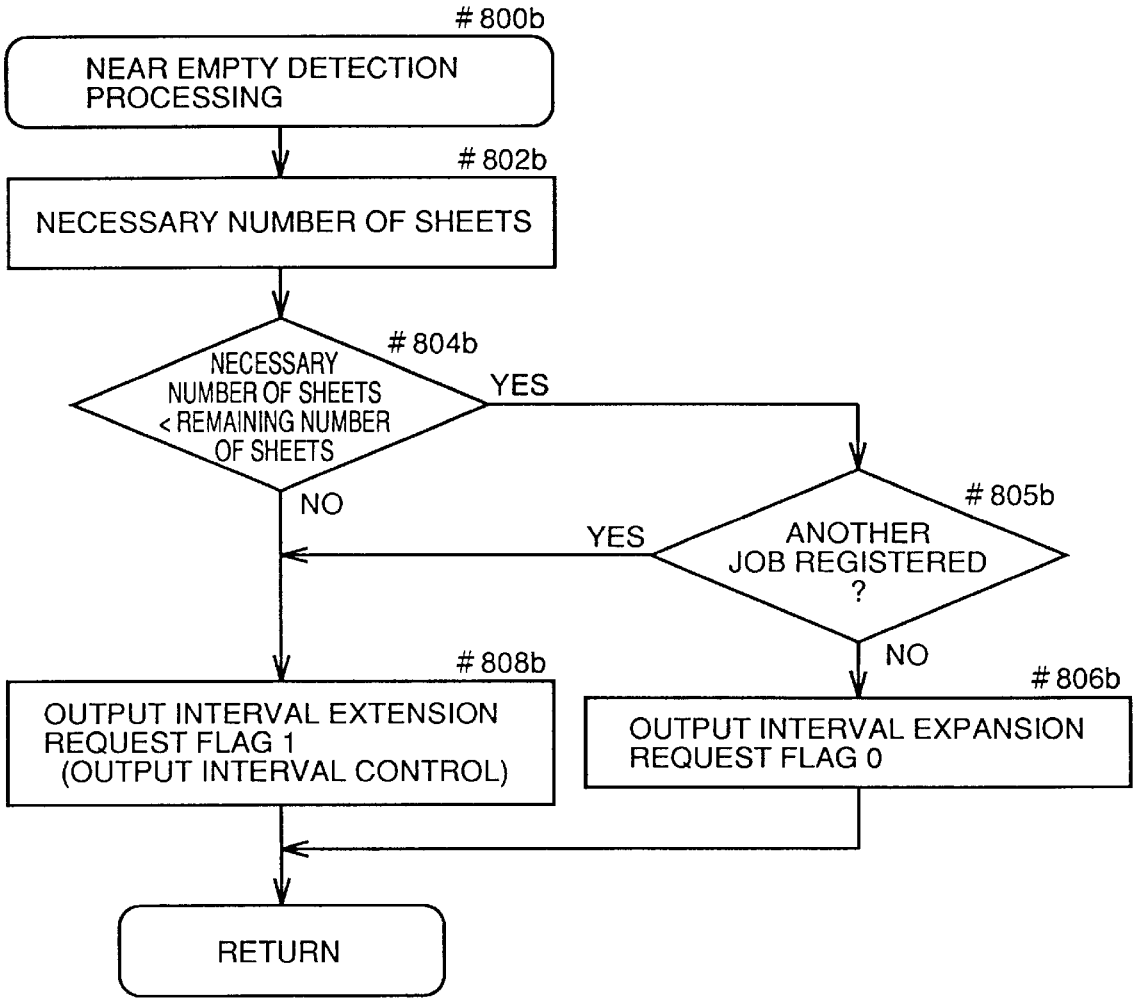
Figure 42:
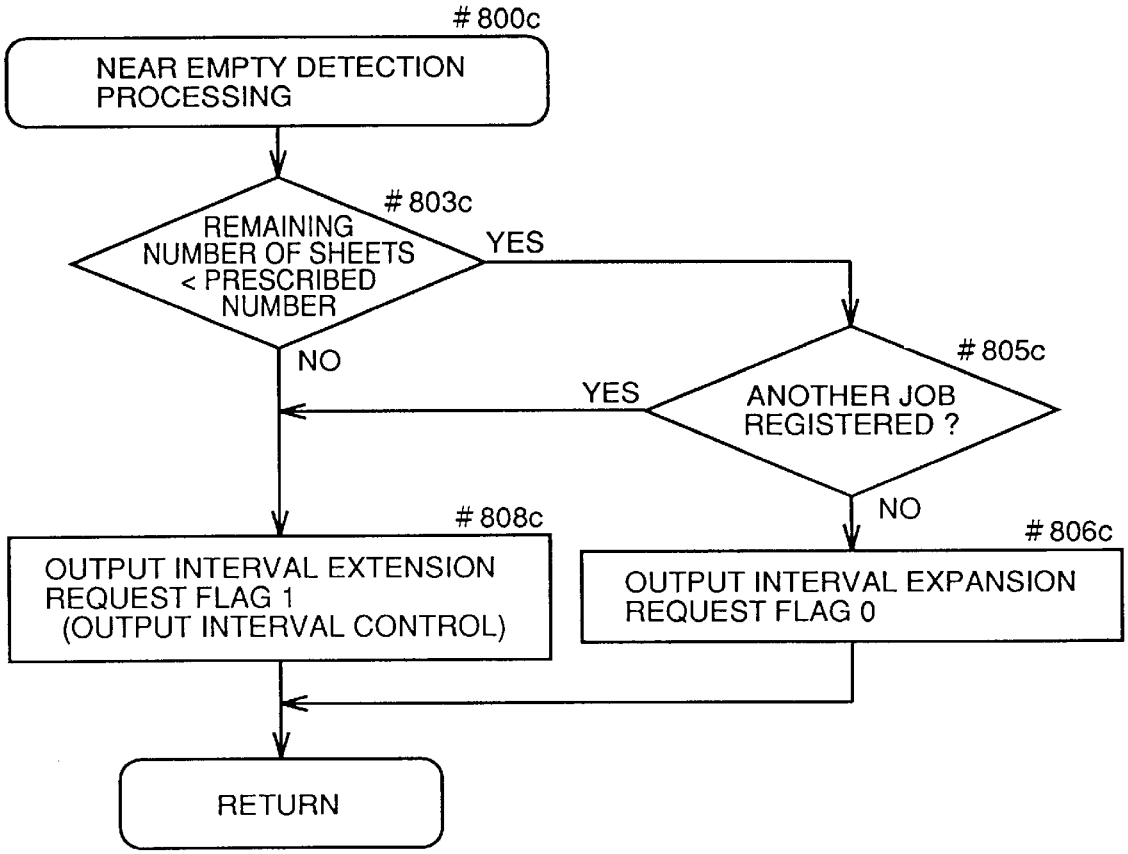

a FIG. 27 shows a memory reading operation by the copying machine according to the second embodiment;

FIG. 28 is a plan view showing the operation panel of the copying machine according to the second embodiment;

FIGS. 29 to 32 are flow charts for use in illustration of the procedure of processings by the CPU of the copying machine according to the second embodiment;

FIGS. 33 and 34 are flow charts for use in illustration of the procedure of processings in a paper empty warning processing by the copying machine according to the second embodiment;

FIG. 35 is a view showing how the paper empty warning is displayed by the copying machine according to the second embodiment;

FIG. 36 is a flow chart for use in illustration of the procedure of processings in stored sheet state detection processing by the copying machine according to the second embodiment;

FIG. 37 is a flow chart for use in illustration of the procedure of processings in a near empty detection processing by the copying machine according to the second embodiment;

FIG. 38 is a flow chart for use in illustration of the procedure of processings in an output interval control processing by the copying machine according to the second embodiment;

FIG. 39 is a flow chart for use in illustration of the procedure of processings in a power supply off control processing by the copying machine according to the second embodiment;

FIG. 40 shows an output interval extension operation by the copying machine according to the second embodiment; and FIGS. 41 and 42 are flow charts for use in illustration of the procedure of processings in the near empty detection processing by the copying machine according to the second embodiment.

DESCRIPTION OF THE PREFERRED EMBODIMENTS

(1) First Embodiment

Figure 1:
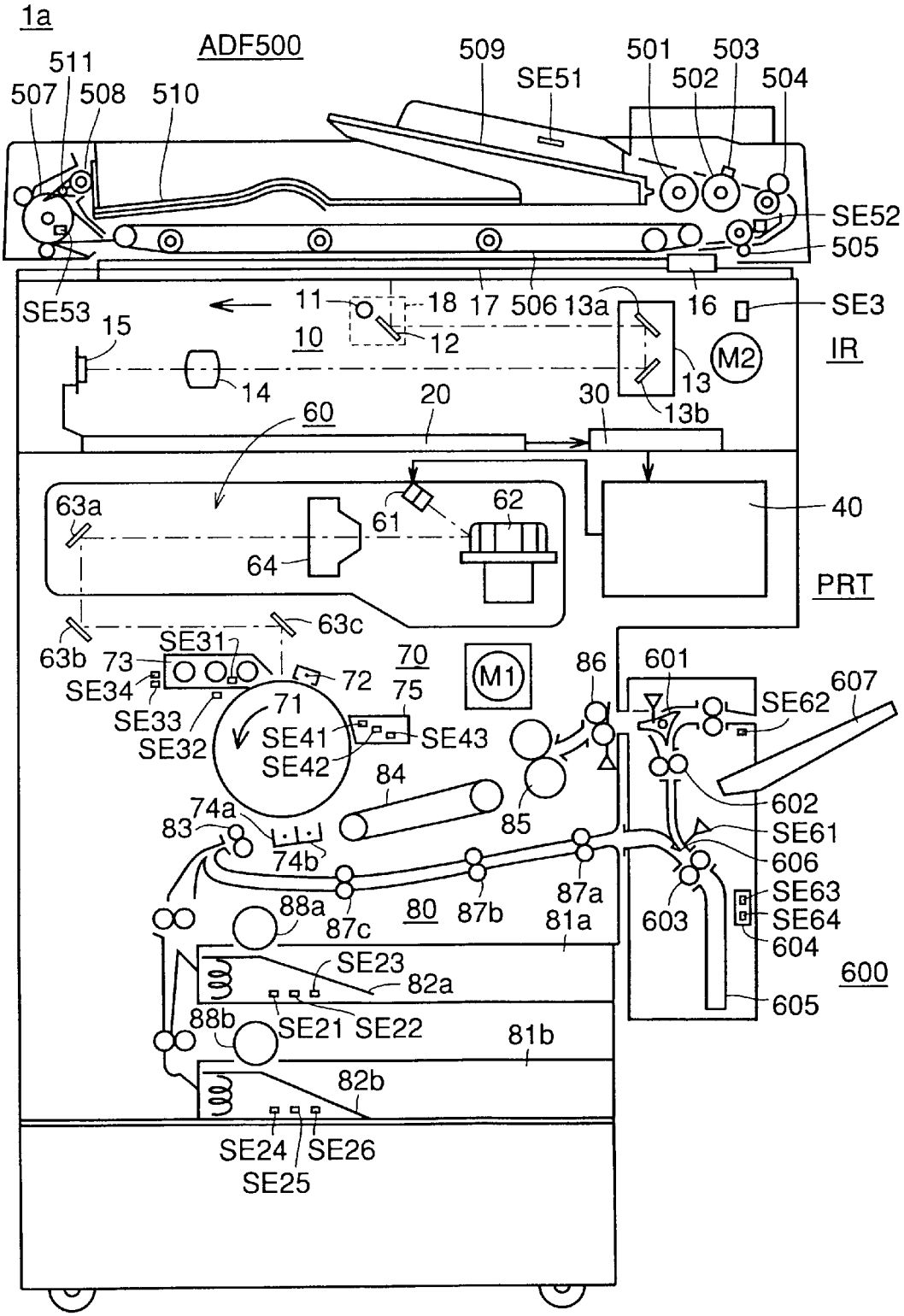
FIG. 1 is a schematic cross sectional view showing the general structure of a digital copying machine according to a first embodiment of the invention.

FIG. 1 is a cross sectional view schematically showing the general structure of a digital copying machine la according to a first embodiment of the invention. Digital copying machine la mainly includes an automatic document feeder ADF, an image reader IR, a page printer PRT, and an operation panel OP (positioned on the top surface of digital copying machine la/perpendicular to the surface of the sheet). These devices are separately or simultaneously controlled by a control unit 200.

A copying operation will be briefly described. A job is input to digital copying machine la through operation panel OP. Automatic document feeder ADF sets a set of documents at the reading position of image reader IR on a one-sheet-basis. Image reader IR then reads the image of the set documents for generating image data. Page printer PRT receives the image data from image reader IR and prints images on sheets of printing paper.

Automatic document feeder ADF is attached to the upper part of digital copying machine la to turn around its one end to be opened and closed (lifted up. and down), and also serves as a document cover. Automatic document feeder ADF includes a paper feeding roller 501, a separation roller 502, a separation pad 503, an intermediate roller 504, a register roller 505, a transport belt 506, an inversion roller 507, a discharge roller 508, a document stacker 509, a document discharge tray 510, a document sensor SE51, a document size sensor SE52, and a discharge sensor SE53.

A stack of documents are placed in document stacker 509 having their image planes to be copied facing upward. Thus placed documents are separated by separation roller 502 and separation pad 503, and fed into paper feeding roller 501 on a one-sheet basis from the lowermost document. The document is then inverted along the transport path by intermediate roller 504, and register roller 505, and accurately set at the reading position on the document glass 17 of image reader IR.

A single-sided document which had its image read by image reader IR is discharged through discharge roller 508 and above a switching claw 511 onto document discharge tray 510 such that the image plane faces upward. A double-sided document which had its one side read similarly to the single-sided document has its front and back reversed by inversion roller 507, its back surface read after returned to the reading position on the document glass 17 by switching claw 511, and is discharged onto document discharge tray 510. Document sensor SE detects the presence/absence of a document, document size sensor SE52 detects whether or not a document is presently being discharged.

Image reader IR includes a scanning system 10 for decomposing a document image into for reading, an image signal processing unit 20 for performing a quantization of a photoelectric conversion signal output from scanning system 10 and signal processings corresponding to various image formation modes, and a memory unit 30 for storing image data transmitted from image signal processing unit 20.

Scanning system 10 is a line-scanning type image reading mechanism. A document irradiation lamp 11 and a mirror 12 are held by a first scanner 18, which is driven by a scan motor M2. The documents set at the reading position on document glass 17 is irradiated with light from document irradiation lamp 11. Light reflected from the document passes through mirror 12, a second scanner 13 including fixed mirrors 13*a* and 13*b*, and a light collecting lens 14 and input into an image sensor 15 formed of a CCD array. The resulting signal therein is sent to image signal processing unit 20. A document scale 16 positioned beside document glass 17 is used to show a reference for the user to manually set a document at the reading position. There is provided a sensor SE3 near document scale 16 for detecting first scanner 18 being at the home position.

Image signal processing unit 20 performs image processings to the signal input from scanning system 10 such as binarization, picture quality correction, changing magnification, and image editing, and memory unit 30 temporarily stores resulting image data.

Page printer PRT prints out a copied image based on the image data transferred from image reader IR by means of electro-photographic process. Page printer PRT includes a printing processing unit 40 for outputting an exposure control signal, an optical system 60 for irradiating a laser beam in response to the exposure control signal from printing processing unit 40, an image forming system 70 for performing an image forming processing to a paper sheet irradiated with the laser beam from optical system 60, a paper transport system 80 for transporting the paper sheet to image forming system 70, and a paper re-feeding unit 600 for re-feeding the sheet if necessary.

Printing processing unit 40 controls a laser beam irradiated by optical system 60 based on image data from memory unit 30 in image reader IR.

A semiconductor laser 61 irradiates a laser beam under the control of printing processing unit 40. The laser beam is deflected into a main scanning direction by a polygon mirror 62 rotated by a polygon motor, and guided into an exposure position on a photoreceptor.drum 71 in optical system 70 via a main lens and mirrors 63*a*, 63*b* and 63*c* positioned in various locations.

In optical system 70, photoreceptor drum 71 is evenly charged by a corona charger 72, and irradiated with a laser beam from optical system 60 as described above, and a latent electrostatic image is formed on photoreceptor drum 71. Then, toner is placed on the latent electrostatic image by a developer 73, and the latent electrostatic image is formed into a toner image. Thus formed toner image is separated from photoreceptor drum 71 by a transfer charger 74*a* and a separation charger 74*b* at a transfer position and transferred onto a paper sheet transported by paper sheet transport system 80. Toner remaining on photoreceptor drum 71 after the transfer is removed by a cleaner (not shown) and collected to a bottle 75.

In paper sheet transport system 80, a paper sheet from paper feeding cassette 81*a* and 81*b* is sent onto the transfer position in synchronization with the toner image on photoreceptor drum 71 by a timing roller 83. The paper sheet after the transfer is transported to a fixation roller pair 85 by the function of transport belt 84, and the toner image is fixed onto the paper sheet by heat and pressure. Each element of paper feeding transport system 80 and photoreceptor drum 71 are driven by a main motor M1.

In this embodiment, paper feeding cassette 81*a* stores A4Y-size (A4 crosswise size) sheets, while paper feeding cassette 81*b* stores B5Y-size (B5 crosswise size) sheets. Paper sheets are fed from paper feeding cassettes 81*a* and 81*b* by paper feeding rollers 88*a* and 88*b* and sent onto the transfer position.

Paper re-feeding unit 600 is provided on a side face of page printer PRT as an additional device for automatizing a double-sided copying operation. Paper re-feeding unit 600 can temporarily store a paper sheet discharged from the main body of page printer PRT by the discharge roller 86 of paper sheet transport system 80 and send the sheet back to the page printer main body by switch-back transportation. The paper re-feeding unit having a staple unit 604 and staple tray 605 can bind a set of copied paper sheets by automatically stapling them if necessary.

When a copying operation is performed to one side of a sheet, the sheet is discharged onto discharge tray 607 simply passing through paper re-feeding unit 600. During a copying operation to both sides, the left end of a switching claw 601 is moved upwardly by a solenoid coil which is not shown. A paper sheet discharged from discharge roller 86 reaches a forward inversion roller 603 through transport roller 602. When the trailing edge of the paper sheet is detected by paper sheet sensor SE61, forward inversion roller 603 is inverted. The inversion returns the paper sheet to the main body of page printer PRT. Thus returned paper sheet passes through horizontal transport rollers 87*a*, 87*b* and 87*c*, in synchronization in timing with photoreceptor drum 71 and then send to the transfer position.

If a plurality of sheets are sequentially fed, the sheets are sent one after another into paper re-feeding unit 600 at described intervals such that they are not placed upon each other. Since the length of the transport path of sheets is fixed, the number of sheets (maximum circulation number) N in a single circulation through paper re-feeding unit 600 and horizontal transport rollers 87*a*, 87*b* and 87*c* depends on the size of sheets.

Page printer PRT is also provided with the following sensors.

Developer 73 is provided with sensors SE33 and SE34 for detecting the remaining amount of toner in a developing agent, a sensor SE32 detecting the presence/absence of toner, and a sensor SE31 for detecting the density of toner. Paper feeding cassettes 81*a* and 81*b* have lifting plates 82*a* and 82*b* which move up and down depending upon the volume of sheets. The position of lifting plate 82*a* is detected by sensors SE21, SE22 and SE23, while the position of lifting plate 82*b* is detected by sensors SE24, SE25 and SE26. Thus, the remaining number of sheets is detected.

Bottle 75 for storing toner collected after the completion of image formation has sensors SE41, SE42, and SE43 for detecting the amount of toner, and staple unit 604 has sensors SE63 and SE64 for detecting the remaining number of staples.

Discharge tray 607 has a sensor SE62 for detecting an over-capacity for discharged sheets.

Figure 2:
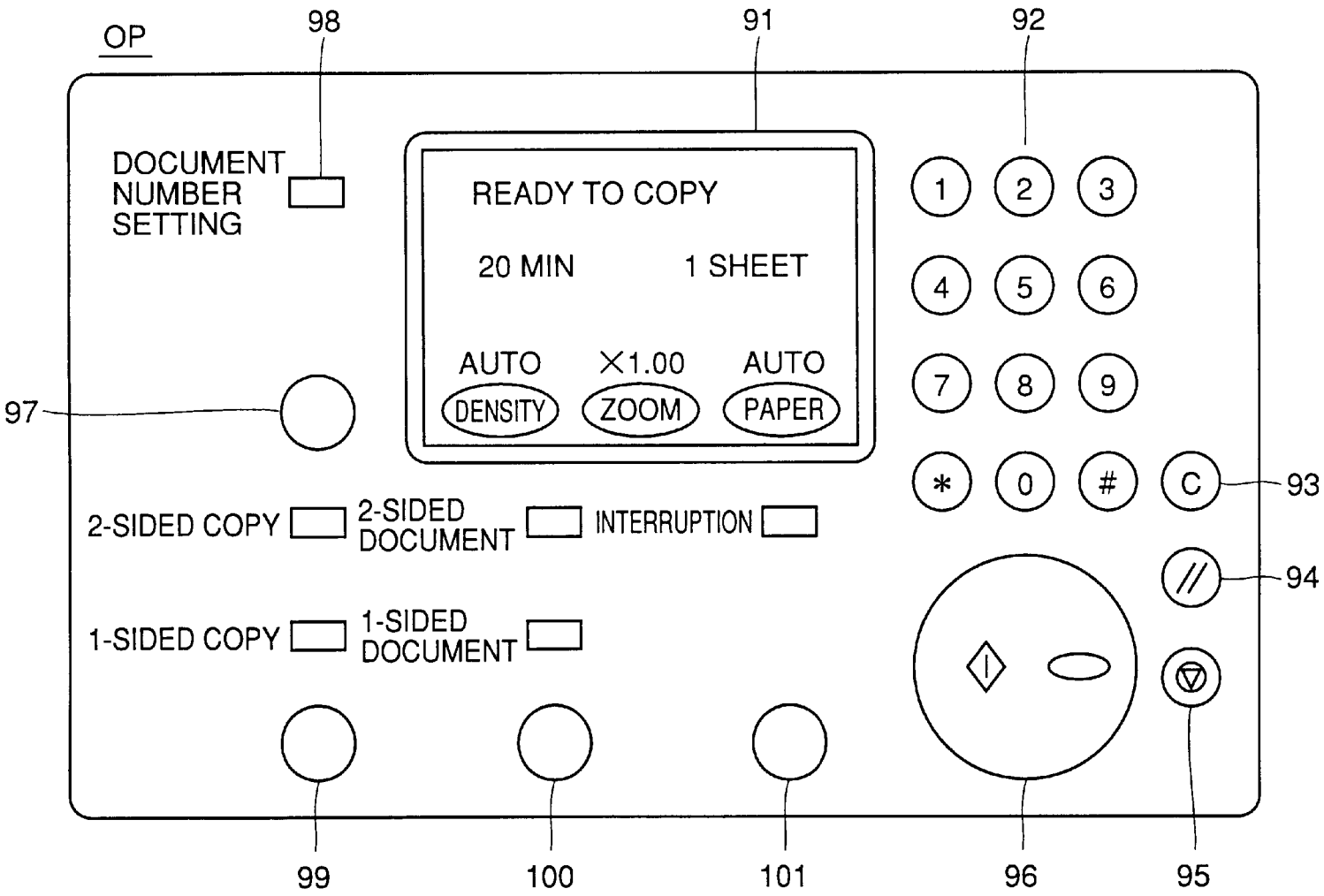
FIG. 2 is a plan view showing the arrangement of an operation panel OP in the digital copying machine.

FIG. 2 is a plan view showing the structure of operation panel OP in digital copying machine la according to the first embodiment. Operation panel OP includes a liquid crystal touch panel LCD 91, a ten key 92, a clear key 93, a panel reset key 94, a stop key 95, a start key 96, a document number setting key 97, an LED 98, a copy mode key 99, a document specification key 100, and an interruption key 101.

Liquid crystal touch panel 91 is used to display various states and to specify various modes, ten key 92 is used to input a numerical condition (such as the number of copies and a magnification) in a copying operation, and clear key 93 is used to return the set numerical condition to standard values.

Panel reset key 94 is used to initialize a copy mode, and stop key 95 is used to instruct to stop a copying operation, and start key 96 is used to instruct to start a copying operation.

Document number setting key 97 is used to input the number of documents placed on the document stacker 509 of automatic document feeder ADF, and LED 98 flashes as the number of document is being input. Copy mode key 99 is used to switch between single-sided copying and double-sided copying, and document specification key 100 is used to specify if the document is a single-sided document or a double-sided document. Interruption key 101 is used to activate interruption and to reset the machine.

Figure 3:
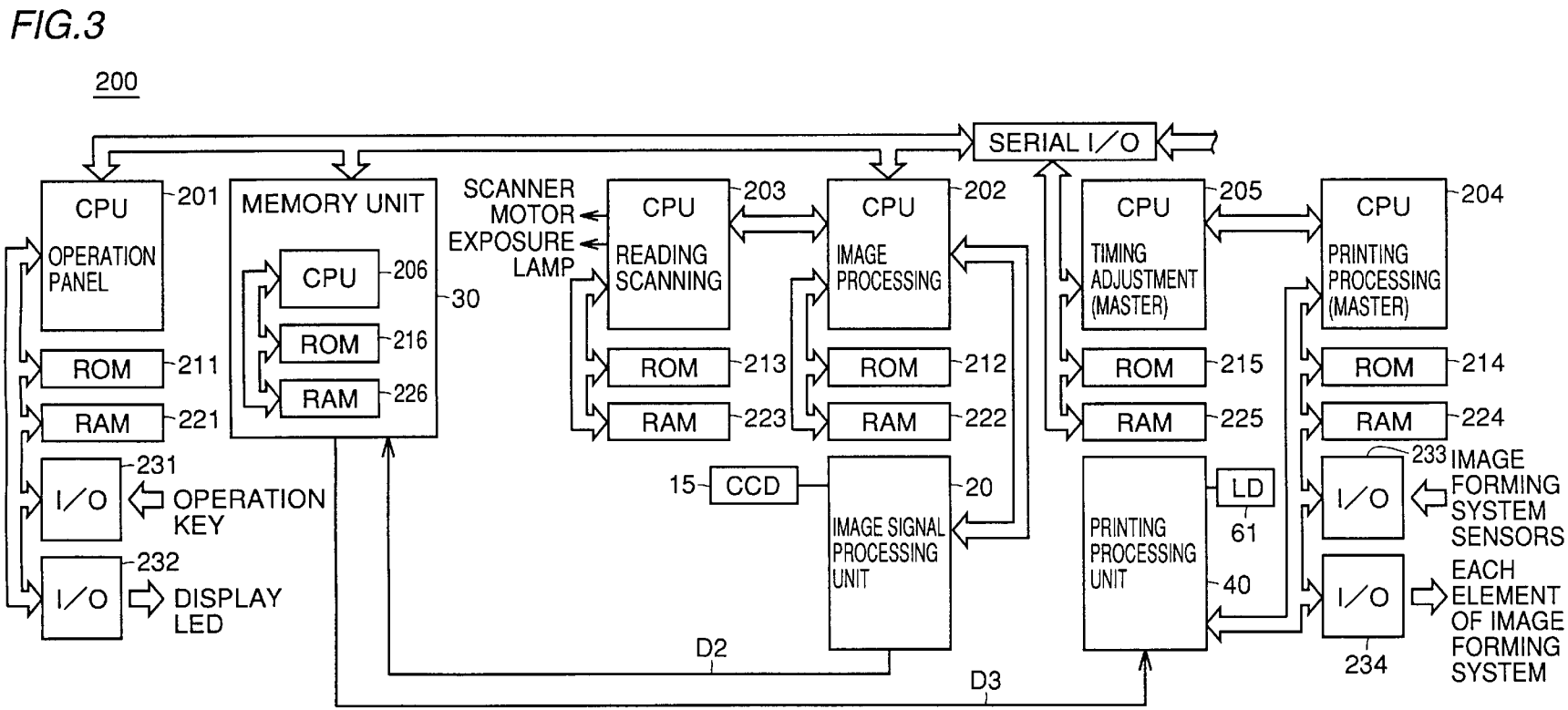
FIG. 3 is a block diagram showing the configuration of the control unit of the digital copying machine.
Figure 4:
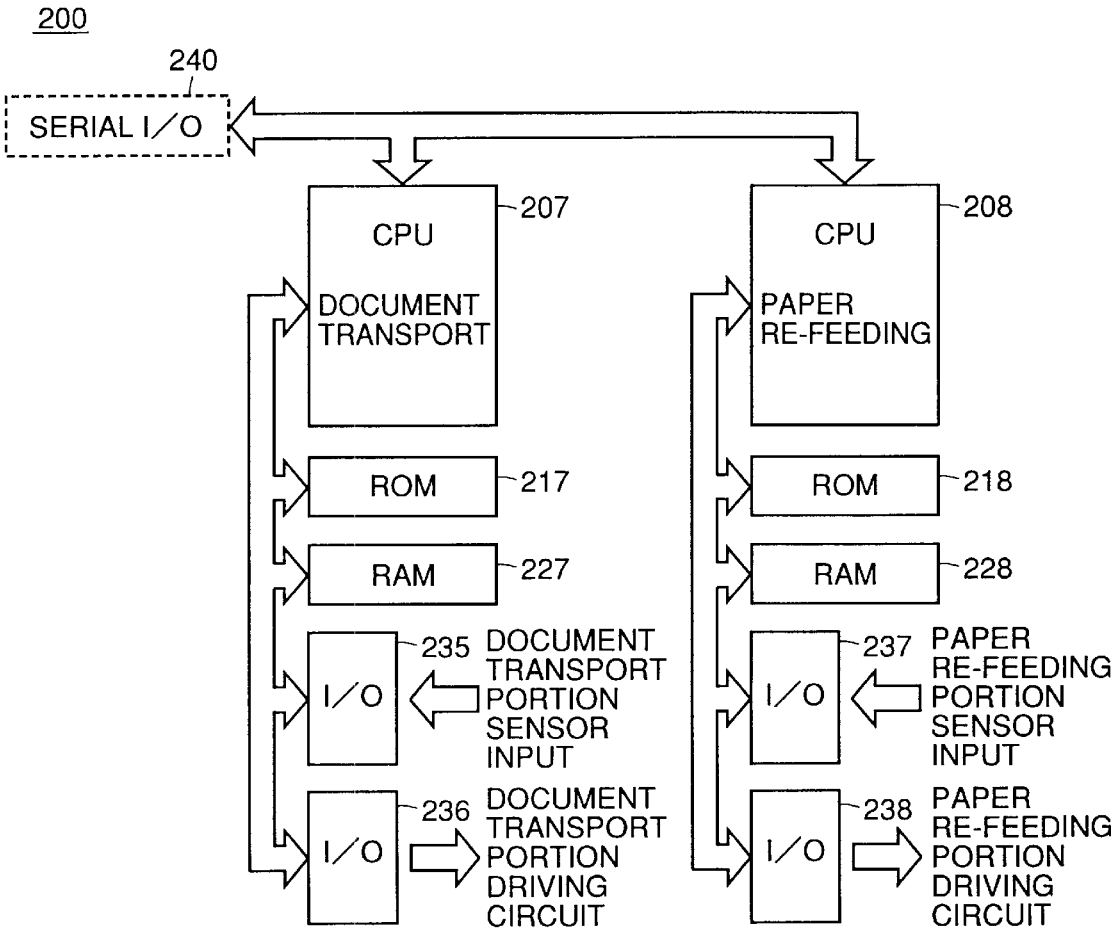
FIG. 4 is another block diagram showing the configuration of the control unit of the digital copying machine.

FIGS. 3 and 4 are block diagrams each showing the configuration of control unit 200 in digital copying machine 1*a*.

Control unit 200 is mainly formed of eight CPUs 201 to 208, which are connected with ROMs 211 to 218 storing programs and RAMs 221 to 228 serving as work areas, respectively. These CPUs 201 to 204 and 206 to 208 are connected through a serial I/O 240 with each other around CPU 205, and timely exchange necessary command information by interruption processings by CPU 205.

Furthermore, CPUs 202 and 203 are connected with each other to exchange necessary command information. CPU 206 is provided in memory unit 30.

Each CPU is further connected with the following devices.

CPU 201 is connected with various operation keys 92 to 97, and 99 to 101 on operation panel OP through an I/O interface 231, and connected with the liquid crystal touch panel 91 of operation panel OP through an I/O interface 232. CPU 201 controls input of signals from various operation keys 92 to 97, and 99 to 101 an operation panel OP through I/O interface 231, and controls display on liquid crystal panel 91 through I/O interface 231.

CPU 202 is connected with image signal processing unit 20 having image sensor 15. CPU 202 controls each element of image signal processing unit 20.

CPU 203 is connected with the document irradiation lamp 11 of scanning system 10 and scan motor M2. CPU 203 controls driving of scanning system 10.

CPU 204 is connected with printing processing unit 40 having semiconductor laser 61. CPU 204 is connected with image forming sensors SE21 to SE26, SE31 to SE34, SE41 to SE43, and SE62 to 64 through an I/O interface 233, and is also connected with a driving circuit for image forming system 70 through an I/O interface 234. CPU 204 performs overall control of page printer PRT including printing processing unit 40.

CPU 205 performs processings for adjusting general timings for control unit 100 and setting operation modes. In order to perform these processings, CPU 205 performs serial communication with each CPU connected to CPU 205 through a serial I/O 240, and transmits/receives commands and reports necessary for the control.

CPU 206 is provided in memory unit 30 and controls storing and reading of image information. Memory unit 30 is connected with image signal processing unit 20 and printing processing unit 40. Memory unit 30 receives image data D2 from image signal processing unit 20, and sends image data D3 to printing processing unit 40.

CPU 207 is connected with each sensor in automatic document feeder ADF through an I/O interface 235 and is also connected with a driving circuit for automatic document feeder ADF through an I/O interface 236. CPU 207 controls input of signals from sensors SE51, SE52 and SE53 in automatic document feeder ADF through I/O interface 235, and controls transportation of documents by automatic document feeder ADF through I/O interface 236.

CPU 208 is connected with each sensor in paper re-feeding unit 600 through an I/O interface 237, and is connected with a driving circuit for paper re-feeding unit 600 through an I/O interface 238. CPU 208 controls input of signals from the sensors of paper re-feeding unit 600 through I/O interface 237, and controls paper re-feeding by paper re-feeding unit 600 through I/O interface 238.

Now, the procedure of controls executed by CPU 201 and CPU 204 particularly related to the present invention will be described by referring to the flow charts.

First, the procedure of controls executed by CPU 201 to operation panel OP will be described.

Figure 5:
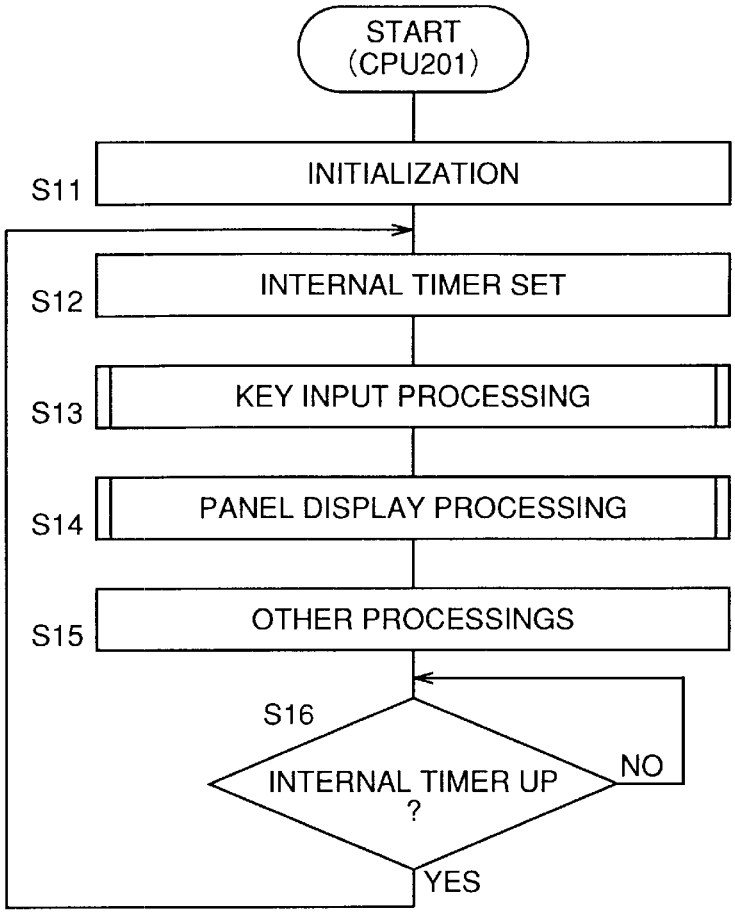
FIG. 5 is a flow chart for use in illustration of a main routine for the procedure of control executed by a CPU 201.

FIG. 5 is a flow chart for use in illustration of a main routine for the procedure of controls executed by CPU 201.

When the power supply is turned on, CPU 201 initializes RAM 221, a register and the like in step 11 (hereinafter "step" is abbreviated as "S"), and sets the internal timer defining the length of 1 routine in S12, followed by a key input processing to accept a key operation in S13, a panel display processing to make display corresponding to the operation in S14, and other processings in S15. The key input processing in S13 and the panel display processing in S14 are performed in subroutines, which will be described.

It is then determined in S16 if the internal timer set in S12 has expired. If the internal timer has expired (YES in S16), the one routine has been completed, and the processing from S12 is repeated. If the internal timer has not expired, (NO in S16), the process remains in S16 and waits for the expiration of the internal timer.

Figure 6:
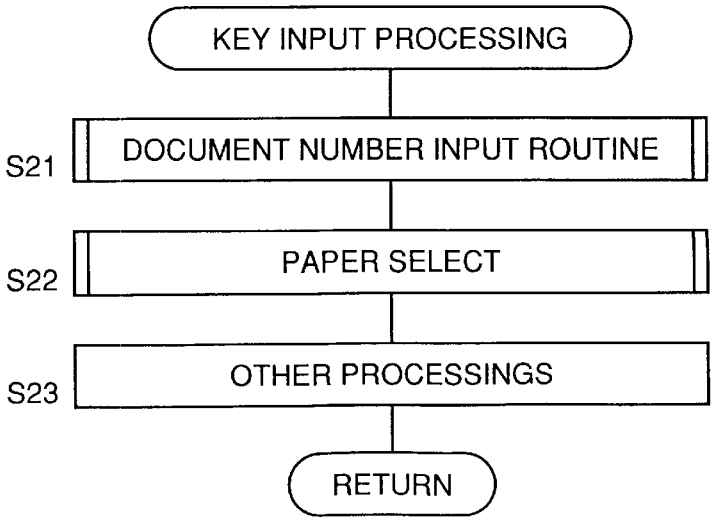
FIG. 6 is a flow chart for use in illustration of the procedure of processings in the key input processing routine in S13 in FIG. 5.

FIG. 6 is a flow chart for use in illustration of the procedure of processings in the key input processing routine in S13 in FIG. 5.

The number of documents set at document stacker 506 in automatic document feeder ADF is input through operation panel OP in the document number input routine in S21, and a copy sheet is selected in the paper select routine in S22. Then, in S23, after the other key input processings are performed, this routine completes.

Figure 7:
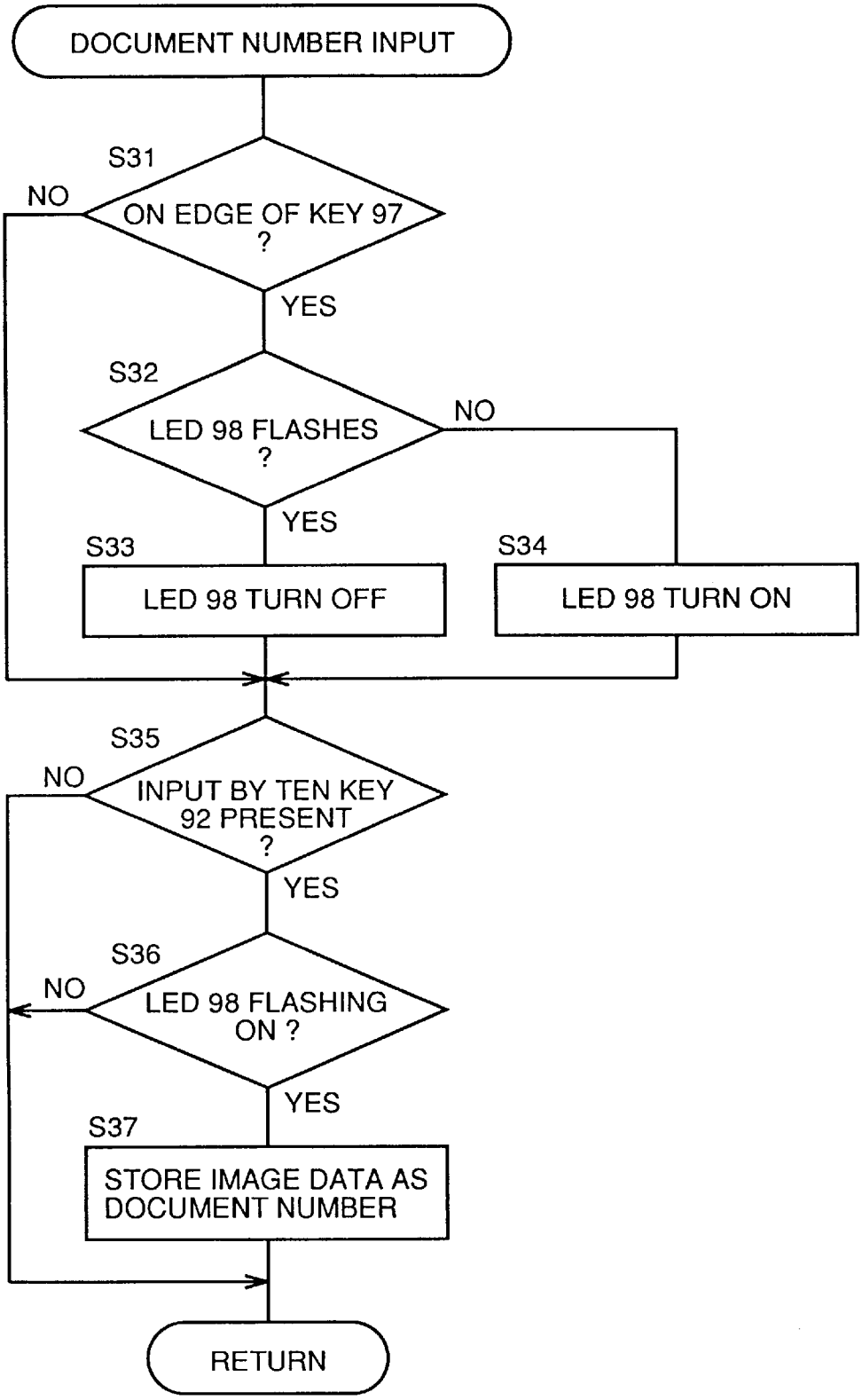
FIG. 7 is a flow chart for use in illustration of the procedure of processings in the document number input routine in S21 in FIG. 6.

FIG. 7 is a flow chart for use in illustration of the procedure of processings in the document number input routine in S21 in FIG. 6.

It is determined in S31 if it is the timing corresponding to a pressing of document number setting key 97 (in FIG. 7, the timing corresponding to a pressing of the key is represented as detection of an on edge of key.) If the timing corresponds to a pressing of document number setting key 97 (YES in S31), it is determined in S32 if LED 98 flashes to indicate that input of the number of documents is in progress. If LED 98 flashes (YES in S32), LED 98 is turned off in S33. Thus, the document number input mode is canceled. If LED 98 does not flash (NO in S32), LED 98 is turned on in S34, and the user is notified of the document number input mode. If it is not the timing corresponding to a pressing of document number setting key 98 (NO in S31), the process skips S32 to S34.

It is then determined in S35 if the timing corresponds to a pressing of ten key 92. If it is the timing corresponding to a pressing of ten key 92 (YES in S35), it is determined in S36 if LED 98 flashes. If LED 98 flashes (YES in S36), data input by ten key 92 is stored as the number of documents in S37, and the routine completes.

If it is not the timing corresponding to a pressing of ten key 92 (NO in S35), or LED 98 does not flash (NO in S36), the process skips S37, and the routine completes as it is.

Figure 8:
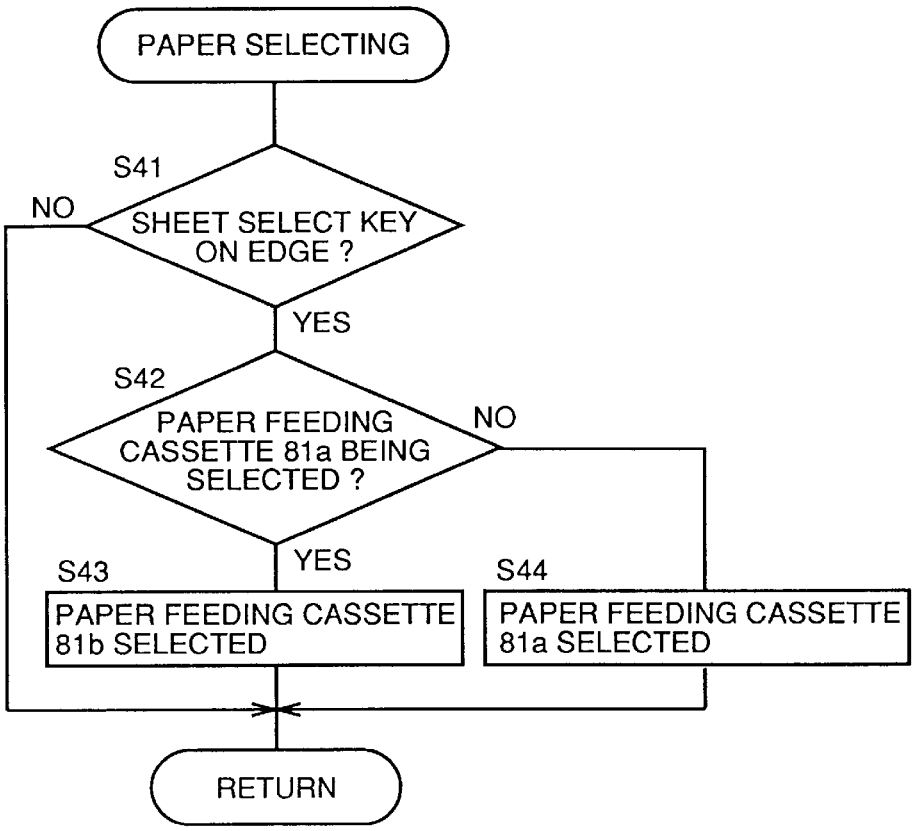
FIG. 8 is a flow chart for use in illustration of the procedure of processings in the paper select routine in S22 in FIG. 6.

FIG. 8 is a flow chart for use in illustration of the procedure of processings in the paper select routine in S22 in FIG. 6.

It is first determined in S41 if it is the timing corresponding to a pressing of paper sheet select key on liquid crystal panel 91 in operation panel OP. If the timing corresponds to a pressing of the paper sheet select key (YES in S41), it is determined if paper cassette 81*a* is presently selected. If paper feeding cassette 81*a* is presently selected (YES in S42), paper feeding cassette 81*b* is selected in S43 and this routine completes. If paper feeding cassette 81*a* is not presently selected (NO in S42), paper feeding cassette 81*a* is selected in S44, and the routine completes. If the timing does not correspond to a pressing of paper sheet select key (NO in S41), this routine completes at the point.

Figure 9:
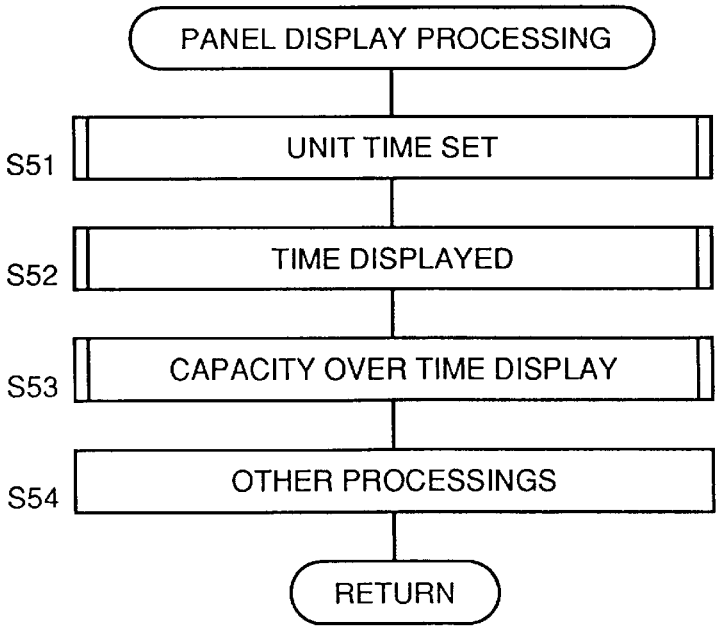
FIG. 9 is a flow chart for use in illustration of the procedure of processings in the panel display routine in S14 in FIG. 5.

FIG. 9 is a flow chart for use in illustration of the procedure of processings in the panel display routine in S14 in FIG. 5.

In the unit time setting routine in S51, a time period necessary for producing one copy is set depending upon a selected sheet size, and a time period until the completion of the entire copying operation is displayed in the time display routine in S52. Then, in the over-capacity time display routine in S53, a time period until a copying operation is stopped in response to the number of discharged sheets exceeds the capacity of the discharge tray is calculated and displayed. In S54, the other display processings are performed.

Figure 10:
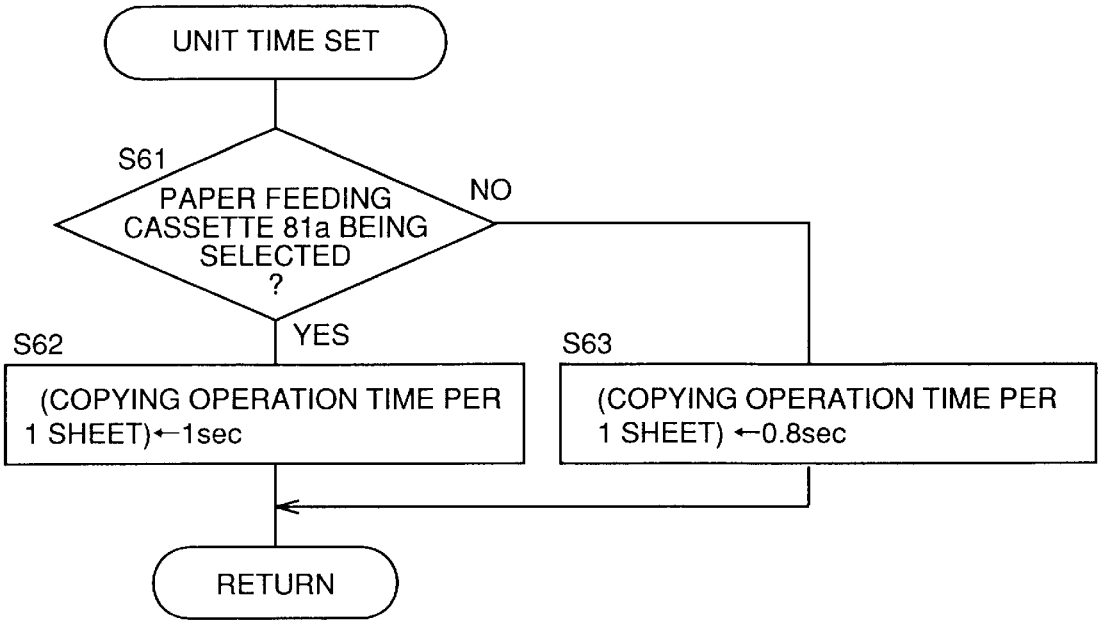
FIG. 10 is a flow chart for use in illustration of the procedure of processings in the unit time setting routine in S51 in FIG. 9.

FIG. 10 is a flow chart for use in illustration of the procedure of processings in the unit time setting routine in S51 in FIG. 9.

It is first determined in S61 if paper feeding cassette 81*a* storing A4Y-size sheets is presently selected. If paper feeding cassette 81*a* is presently selected (YES in S61), a time period of one second is set as time required for copying operation per A4Y-size sheet in S62. If paper feeding cassette 81*a* is presently selected (NO in S61), the time period necessary for copying to a B5Y-size sheet, 0.8 sec is set in S63.

Figure 11:
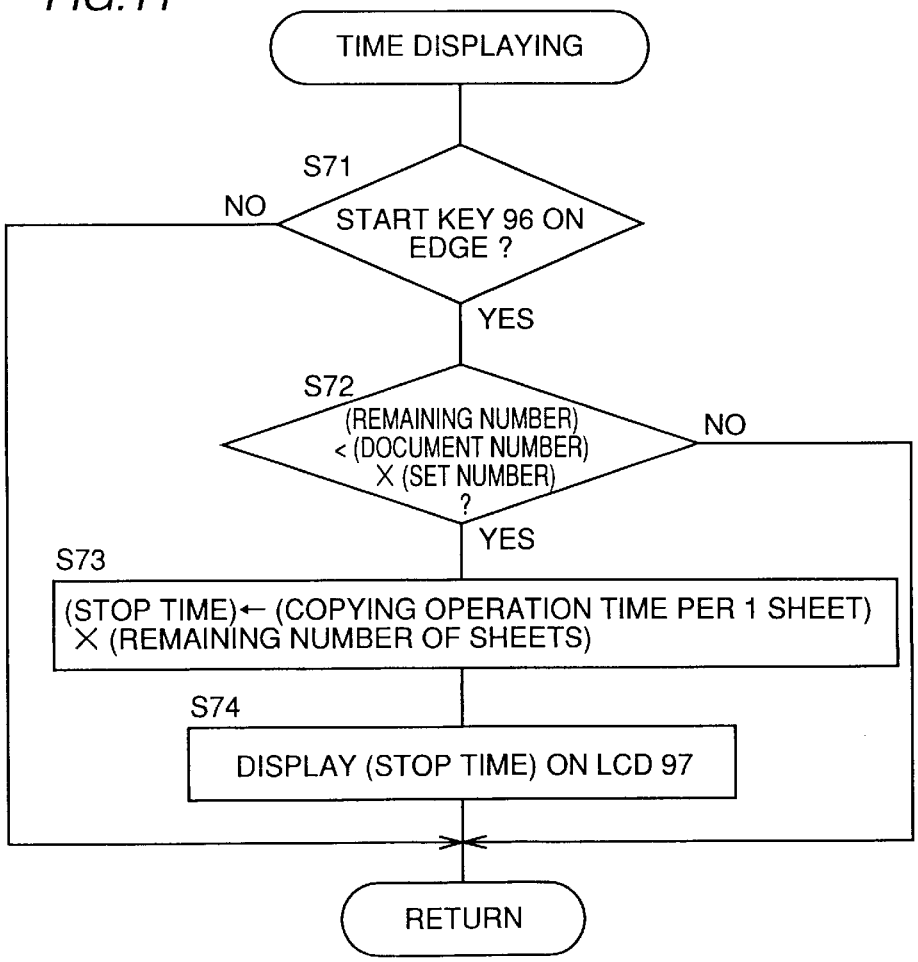
FIG. 11 is a flow chart for use in illustration of the procedure of processings in the time display routine in S52 in FIG. 9.
Figure 12:
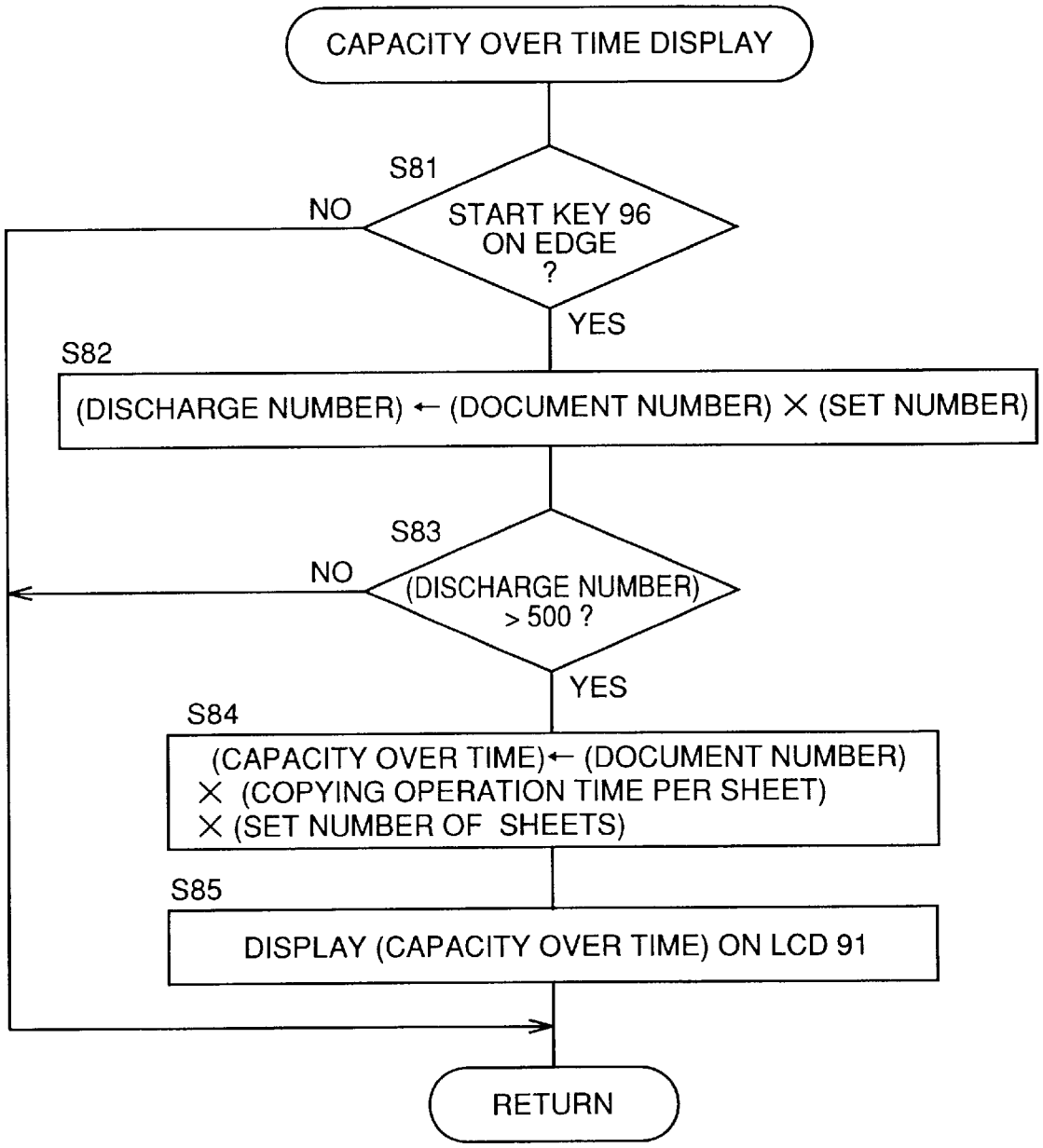
FIG. 12 is a flow chart for use in illustration of the procedure of processings in the over-capacity time display routine in S53 in FIG. 9.

FIG. 11 is a flow chart for use in illustration of the procedure of processings in the time display routine in S52 in FIG. 9. According to the present invention, the time period between the start and end of a copying operation is calculated and displayed based on the remaining amount of toner in developer 73, the remaining number of sheets in paper feeding cassettes 81*a* and 81*b*, the remaining number of staples, the number of toner collected into toner bottle 75 and an over-capacity for the discharge tray. FIG. 11 shows an example of displayed time until a copying operation is stopped based on the remaining number of sheets in a paper feeding cassette, while FIG. 12 shows an example of displaying time until the end of a copying operation based on an over-capacity state for the discharge tray. The time can be calculated based on the combination of the above described plurality of elements. These remaining numbers are detected by-CPU 204 and sent to CPU 201.

It is first determined in S71 if it is the timing corresponding to a pressing of start key 96. If the timing corresponds to a pressing of start key 96 (YES in S71), it is determined in S72 if the remaining number of sheets in a paper feeding cassette is smaller than the necessary number of sheets for completing a copying operation (the product of the number of documents and a set number of copies). If the remaining number of sheets is smaller than the necessary number (YES in S72), a time period produced by multiplying the copying operation time per sheet set in S62 or S63 in FIG. 10 by the remaining number of sheets transmitted from CPU 204 is calculated as interruption time. Then, in S74, the result of calculation, the interruption time is displayed on liquid crystal touch panel (LCD) 91, and this routine completes. Instead of displaying the interruption time, the time produced by adding the interruption time to the present time may be displayed as copying operation stop time.

If the timing does not correspond to a pressing of start key 96 (NO in S71), or if the remaining number of sheets is more than the necessary number (NO in S72), this routine completes at that point.

FIG. 12 is a flow chart for use in illustration of the procedure of processings in the over-capacity time display routine in S53 in FIG. 9.

It is first determined in S81 if it is the timing corresponding to a pressing of start key 96. If the timing corresponds to a pressing of start key 96 (YES in S81), a discharge number produced by multiplying the number of documents by a set number is calculated.

Then, in S83, it is determined if the calculated discharge number is larger than 500. If the discharge number is larger than 500, at which an over-capacity is caused (YES in S83), in S84, the copying operation time per sheet set in S62 or S63 in FIG. 10 is multiplied by the discharge number to produce an over-capacity time. Then, in S85, thus calculated over-capacity time is displayed on liquid crystal touch panel 91 and this routine completes.

If the timing does not correspond to a pressing of start key 96 (NO in S81), or if in S83 the discharge number is smaller than 500 at which an over-capacity is caused (NO in S83), this routine is completed at that point.

If the time of the completion of a copying operation is displayed based on the remaining number of staples, a time period necessary for copying operation per sheet is multiplied by a desired number of copies input through the operation panel followed by addition of a time period required for stapling to produce the copying operation completion time.

A warning to the effect that the image formation is impossible may be displayed as well as the time.

The procedure of controls executed by CPU 204 to page printer PRT will be now described.

Figure 13:
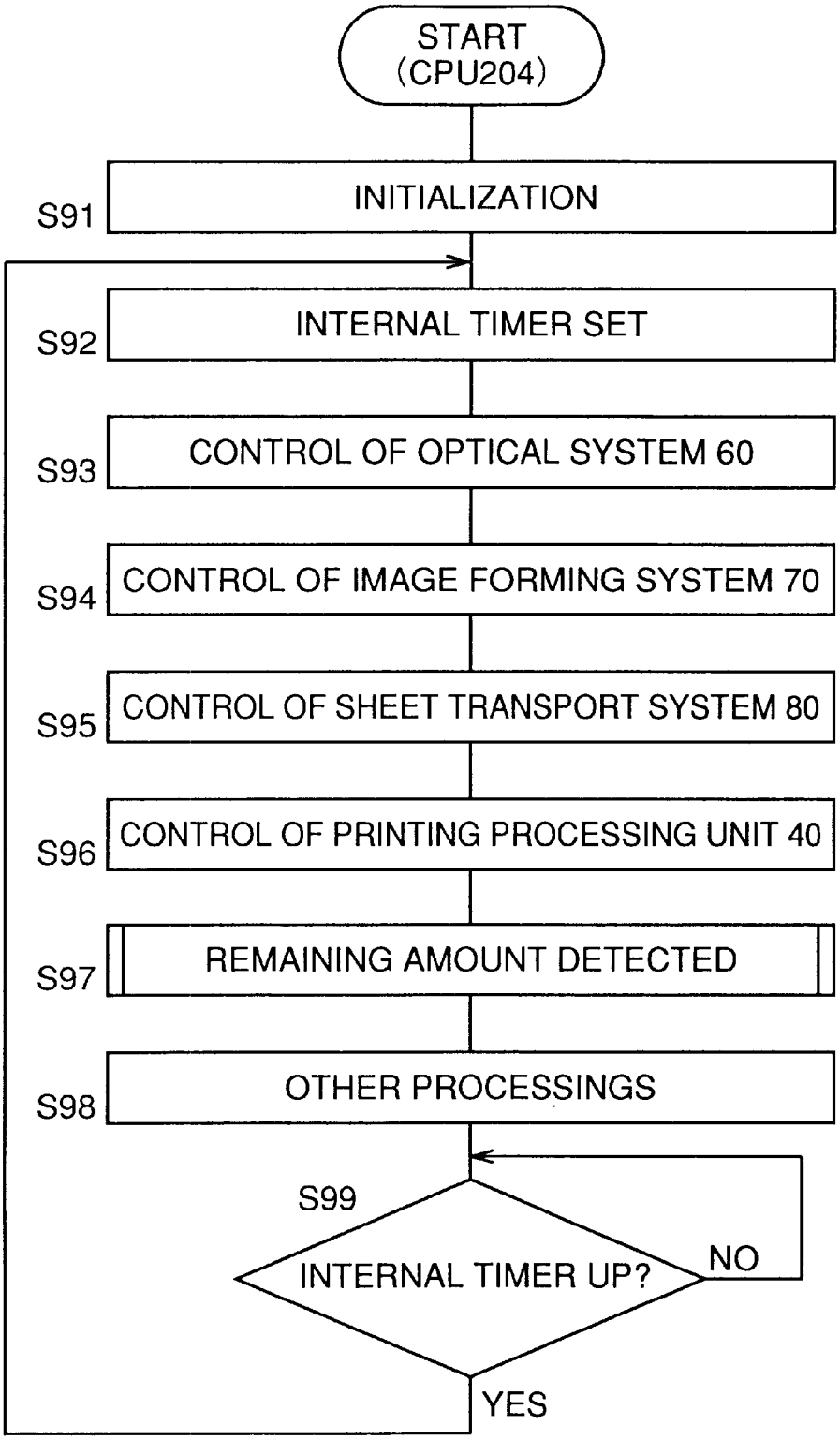
FIG. 13 is a flow chart for use in illustration of a main routine for the procedure of control executed by a CPU 204.

FIG. 13 is a flow chart for use in illustration of a main routine according to the procedure of control executed by CPU 204.

If the power supply is turned on, in CPU 204, RAM 224, a register or the like are initialized in S91, and an internal timer defining the length of one routine is set in S92 followed by control of optical system 60 in S93, control of image forming system 70 in S94, control of sheet transport system 80 in S95, and control of printing processing 40 in S96.

Then, in the remaining amount detection routine in S97, the remaining amount of toner in developer 73, the remaining of sheets in paper feeding cassettes 81*a* and 81*b*, the remaining number of staples, and the amount of toner collected into toner bottles 75 are detected. The subroutine will be described.

Then, the other processings are performed in S98, and it is determined in S99 if the internal timer has expired. If the internal timer has expired (YES in S99), one routine is completed, and the processing is started all over from S92. If the internal timer has not expired (NO in S99), the process remains in S50 and waits for the end of the internal timer.

Figure 14:
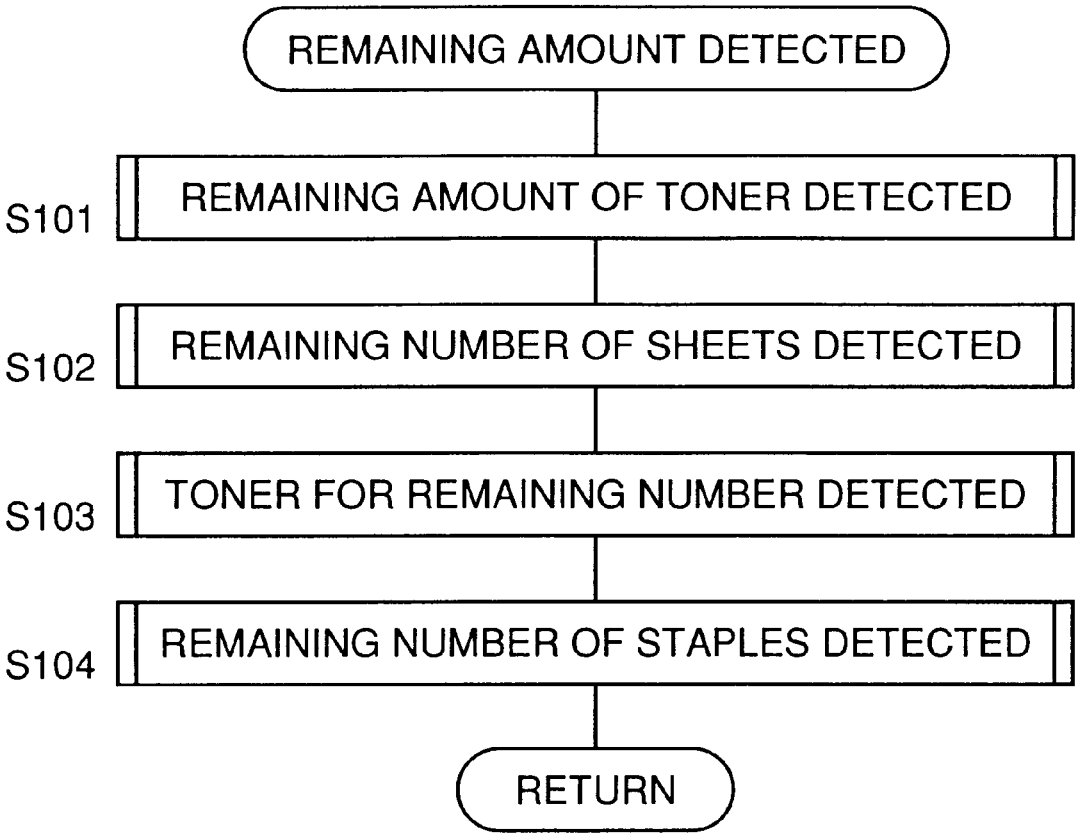
FIG. 14 is a flow chart for use in illustration of the procedure of processings in the remaining sheets detecting routine in S97 in FIG. 13.

FIG. 14 is a flow chart for use in illustration of the procedure of processings in the remaining amount detection routine in S97 in FIG. 13.

In this remaining amount detection routine, a possible number to be copied is detected based on the remaining amount of toner in developer 73 in S101 followed by detection of the number of sheets in paper feeding cassettes 81*a* and 81*b* in S103, detection of a possible number to copy until a copying operation is disabled as the toner bottle is filled in S104, and detection of the remaining number to copy based on the remaining number of staples in S105. After these processings, this routine is completed.

Figure 16:
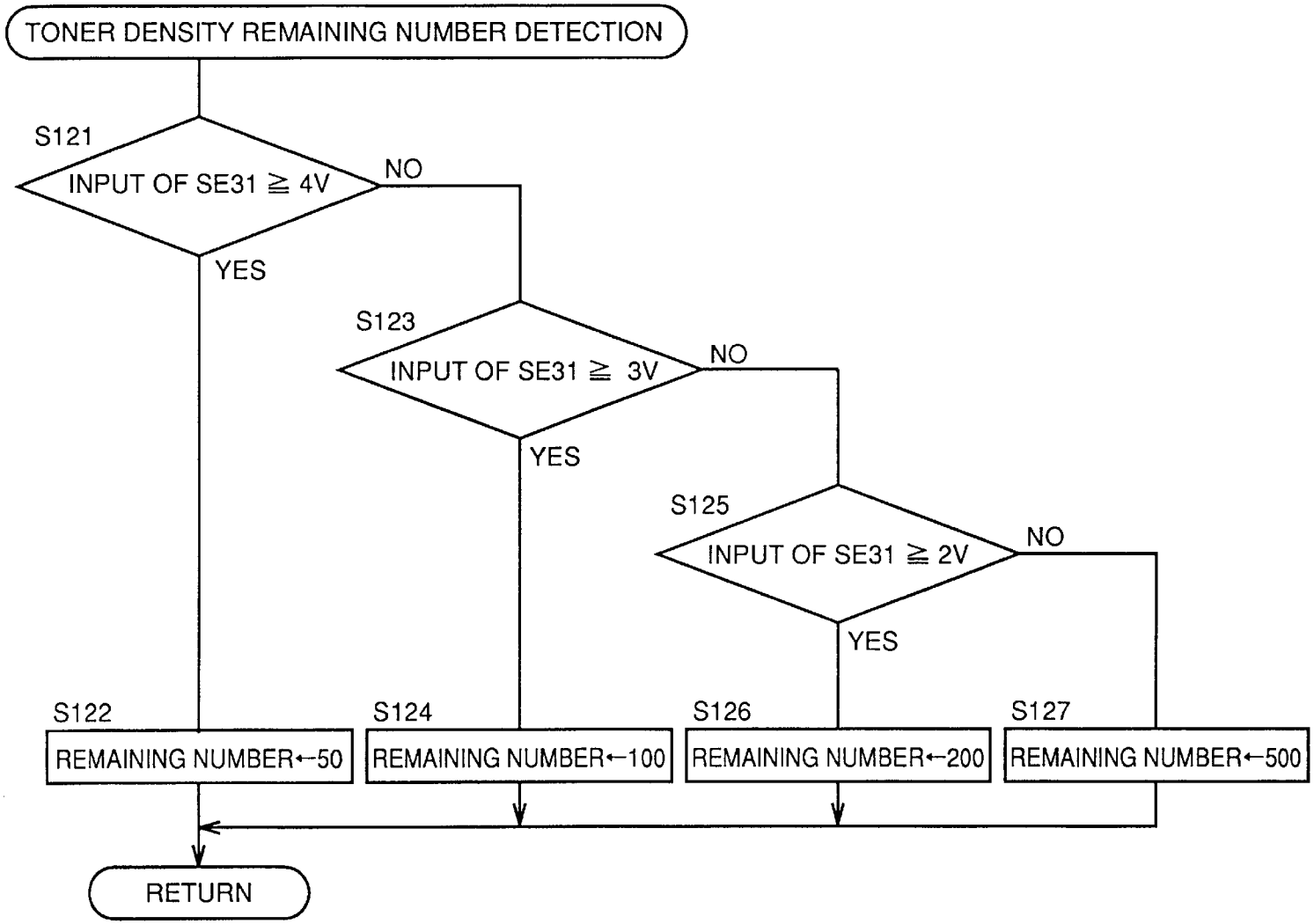
FIG. 16 is a flow chart for use in illustration of the procedure of processings in the toner density remaining number detecting routine in S102 in FIG. 14.

Note that instead of detecting the remaining amount of toner in S101, a possible number to copy may be set by detecting the density of toner as shown in FIG. 16.

Figure 15:
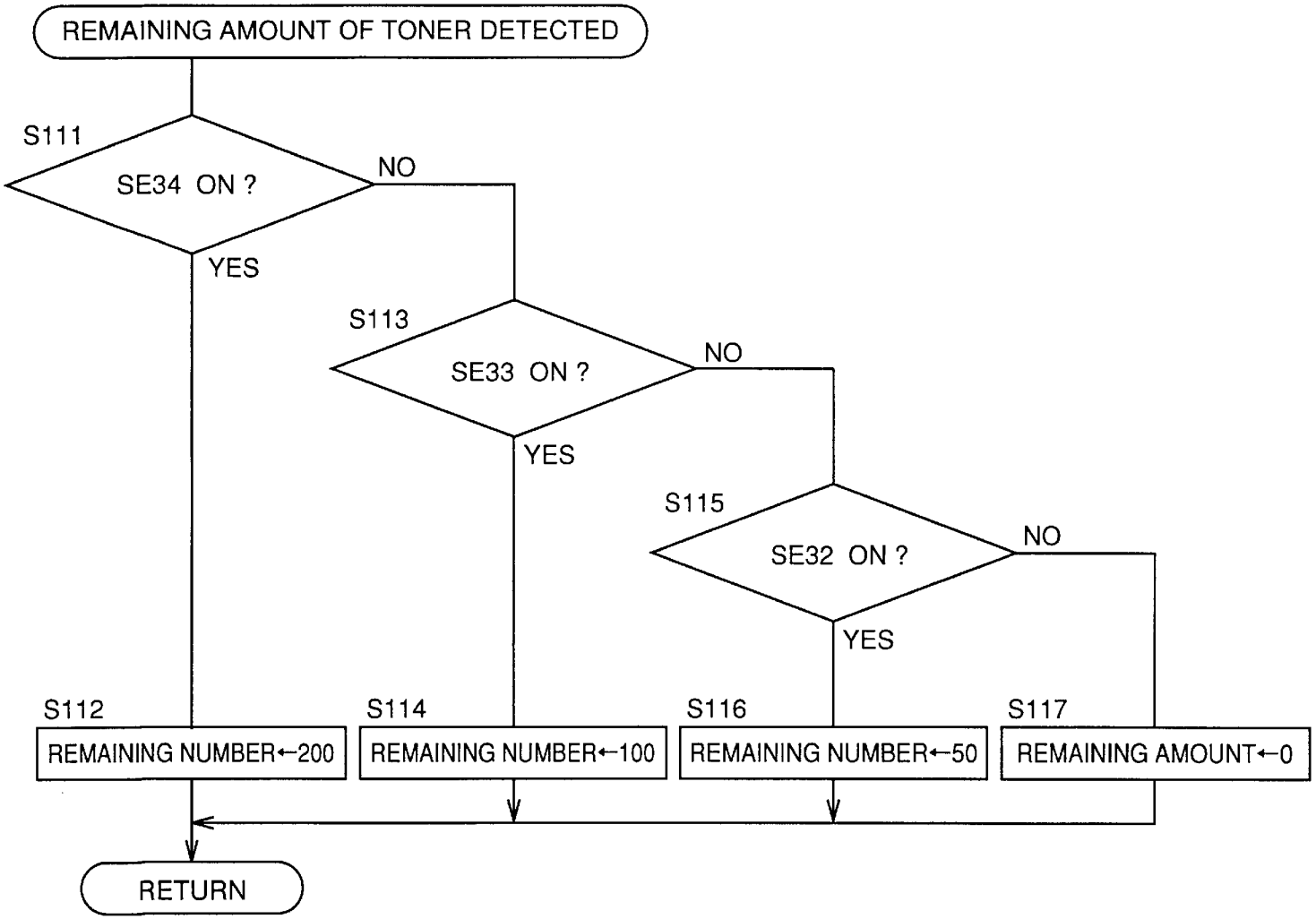
FIG. 15 is a flow chart for use in illustration of the procedure of processings in the toner remaining amount detecting routine in S101 in FIG. 14.

FIG. 15 is a flow chart for use in illustration of the procedure of processings in the toner remaining amount detection routine in S101 in FIG. 14. In this routine, the remaining amount of toner is detected and a possible number to copy is set.

The remaining amount of toner in developer 73 is detected by sensors SE32, SE33 and SE34, and the result of detection is stored in a remaining amount data memory in RAM 224 (hereinafter, in other subroutines, "setting of a number as remaining amount data" refers to storing of the number into the remaining data memory.)

Herein, when sensors SE32, SE33 and SE34 are on, the amount of toner remaining in the apparatus is correlated to the remaining numbers of sheets 50, 100 and 200. If sensors SE32, SE33 and SE34 are all off, the remaining amount of sheets is set to 0.

It is determined in S111 if sensor SE34 is turned on.

If sensor SE34 is turned on (YES in S111), the remaining number, 200 is stored in the remaining amount data memory, and this routine is completed. If sensor SE34 is turned off (NO in S111), it is determined in S113 if sensor SE33 is on. If sensor SE33 is on (YES in S113), the remaining number, 100 is stored in the remaining amount data memory, and this routine is completed.

If sensor SE33 is off (NO in S113), it is determined in S115 if sensor SE32 is on. If the sensor SE32 is on (YES in S115), the remaining number, 50 is stored in the remaining amount data memory in S117, and this routine is completed. If sensor SE32 is off (NO in S115), the remaining number, 0 is stored in the remaining amount data memory in S117, and this routine is completed.

FIG. 16 is a flow chart for use in illustration of the procedure of alternative processings in the remaining amount detection routine in S97 in FIG. 14. In this routine, unlike FIG. 14, the toner density is detected to set a possible number to copy.

The toner density is detected by sensor SE31. The toner density is electrically detected, and density data in the range from 0 to 5 V detected by sensor SE31 is divided by 256 and input to CPU 206 as digital data. The lower the data voltage, the higher the density is.

It is determined in S121 if the density data detected by sensor SE31 is equal or higher than 4 V. If the density data is not less than 4 V (YES in S121), 50 is set as the remaining amount, and this routine is completed. If the density data is less than 4 V (NO in S121), it is determined in S123 if the density data detected by sensor SE31 is not less than 3 V. If the density data is not less than 3 V (YES in S123), 100 is set as the remaining amount, and this routine is completed.

If the density data is less than 3 V (NO in S123), it is determined if the density data detected by sensor SE31 is not less than 2 V. If the density data is not less than 2 V (YES in S125), 200 is set as the remaining amount, and this routine is completed. If the density data is less than 2 V (NO in S125), 500 is set as the remaining amount in S127, and this routine is completed.

Figure 17:
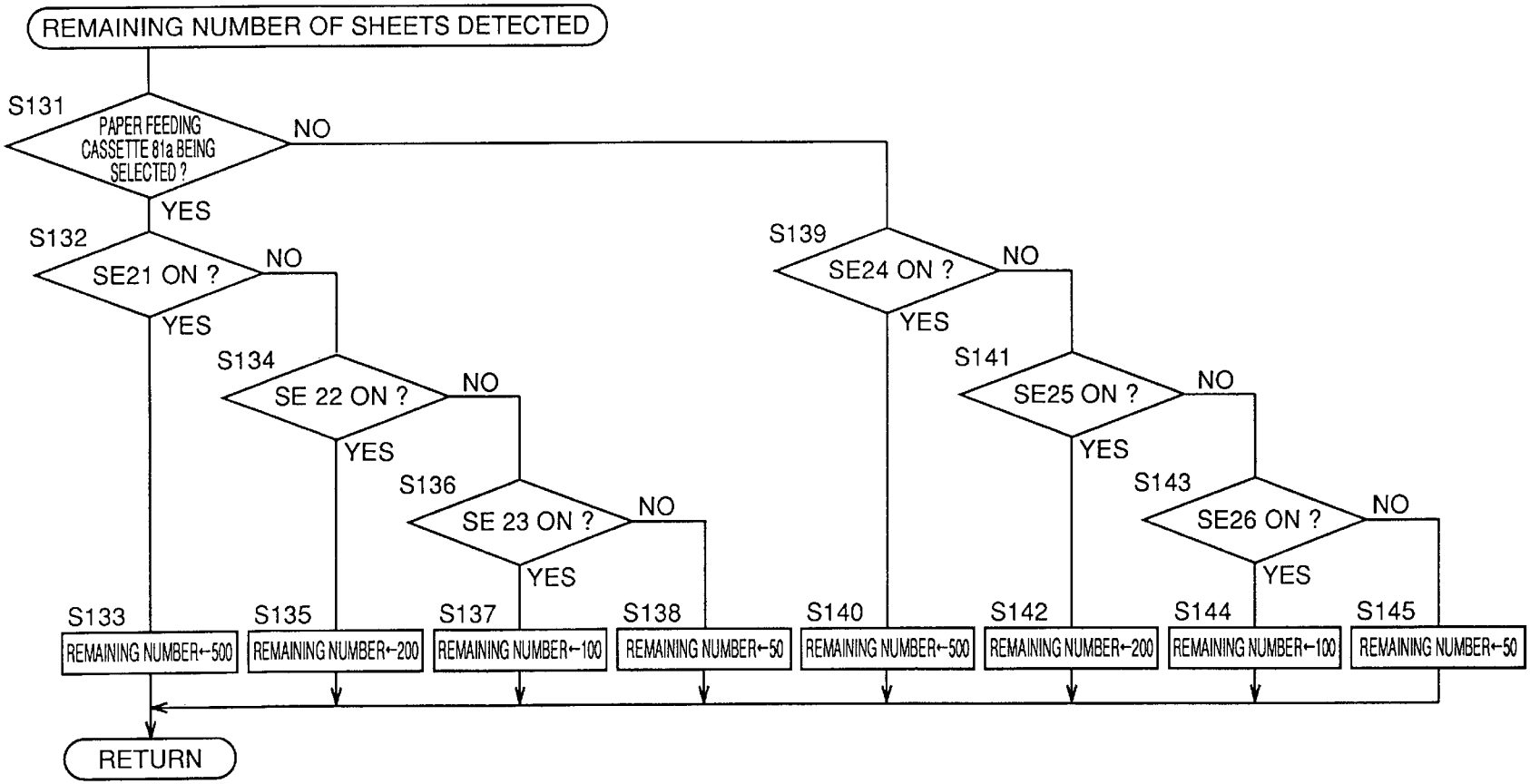
FIG. 17 is a flow chart for use in illustration of the procedure of processings in the remaining sheets detecting routine in S103 in FIG. 14.

FIG. 17 is a flow chart for use in illustration of the procedure of processings in the routine for detecting the remaining number of sheets in paper feeding cassettes 81*a* and 81*b* in S103 in FIG. 14. Sensors SE21, SE22 and SE23 detect the position of lifting plate 82*a* in paper feeding cassette 81*a* to detect the remaining number of sheets, while sensors SE24, SE25 and SE26 detect the position of lifting plate 82*b* in paper feeding cassette 81*b* to detect the remaining number of sheets.

It is determined in S131 if paper feeding cassette 81*a* is presently selected. If paper feeding cassette 81*a* is presently selected (YES in S131), it is determined in S132 if sensor SE21 is on. If sensor SE21 is on (YES in S132), the remaining amount of sheet is set 50 in S133, and this routine is completed. If sensor SE21 is off (NO in S132), it is determined in S134 if sensor SE22 is on. If sensor SE22 is on (YES in S134), the remaining number of sheets is set to 200 in S135, and this routine is completed.

If sensor SE22 is off (NO in S134), it is determined in S136 if sensor SE23 is on. If sensor SE23 is on (YES in S136), the remaining number of sheets is set to 100 in S137, and this routine is completed. If sensor SE 23 is off (NO in S136), the remaining amount of sheets is set to 50 in S138, and this routine is completed.

If paper feeding cassette 81*a* is not presently selected (NO in S131), it is determined in S139 if sensor SE24 is on. If sensor SE24 is on (YES in S139), the remaining number of sheets is set to 500 in S140, and this routine is completed. If sensor SE24 is off (NO in S139), it is determined in S141 if sensor SE25 is on. If sensor SE25 is on (YES in S141), the remaining number of sheets is set to 200 in S142, and this routine is completed.

If sensor SE25 is off (NO in S141), it is determined in S143 if sensor SE26 is on. If sensor SE26 is on.(YES in S143), the remaining number of sheets is set to 100 in S144, and this routine is completed. If sensor SE26 is off (NO in S143), the remaining number of sheets is set to 50 in S145, and this routine is completed.

Figure 18:
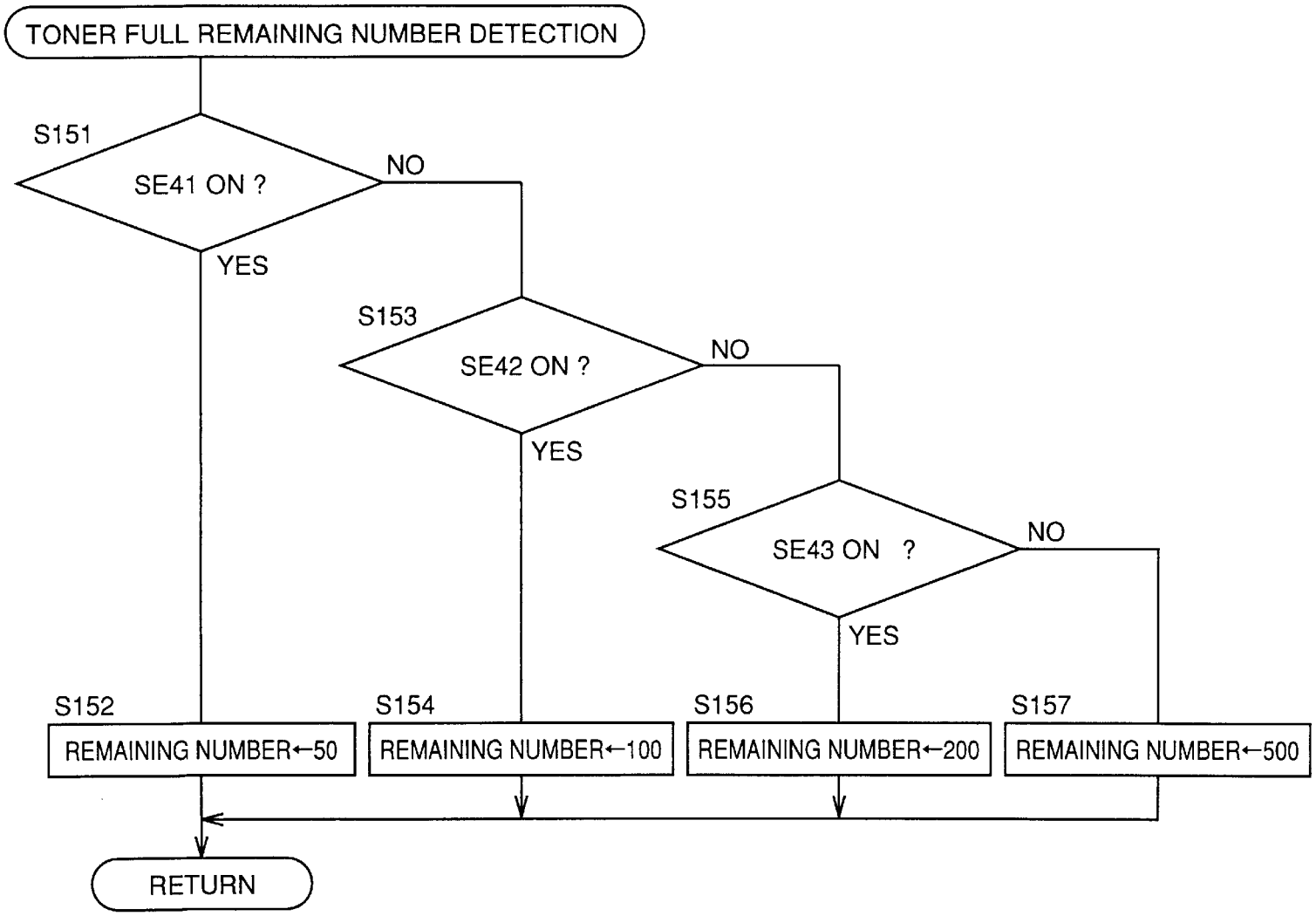
FIG. 18 is a flow chart for use in illustration of the procedure of processings in the toner full remaining number detecting routine in S104 in FIG. 14.

FIG. 18 is a flow chart for use in illustration of the procedure of processings in the toner full remaining number detection routine in S104 in FIG. 14. In this routine, a possible amount of unnecessary toner to be collected into bottle 75 is detected by sensors SE41, SE42, and SE43, and the remaining number of sheets is set accordingly.

It is determined in S151 if sensor SE41 is on. If sensor SE41 is on (YES in S151), the remaining number of sheets is set to 50 in S152, and this routine is completed. If sensor SE41 is off (NO in S151), it is determined in S153 if sensor SE42 is on. If sensor SE42 is on (YES in S153), the remaining number of sheets is set to 100 in S154, and this routine is completed.

If sensor SE42 is turned off (NO in S153), it is determined if sensor SE43 is on in S155. If sensor SE43 is on (YES in S155), the remaining number of sheets is set to 200 in S156, and this routine is completed. If sensor SE43 is off (NO in S155), the remaining number of sheets is set to 500 in S157, and this routine is completed.

Figure 19:
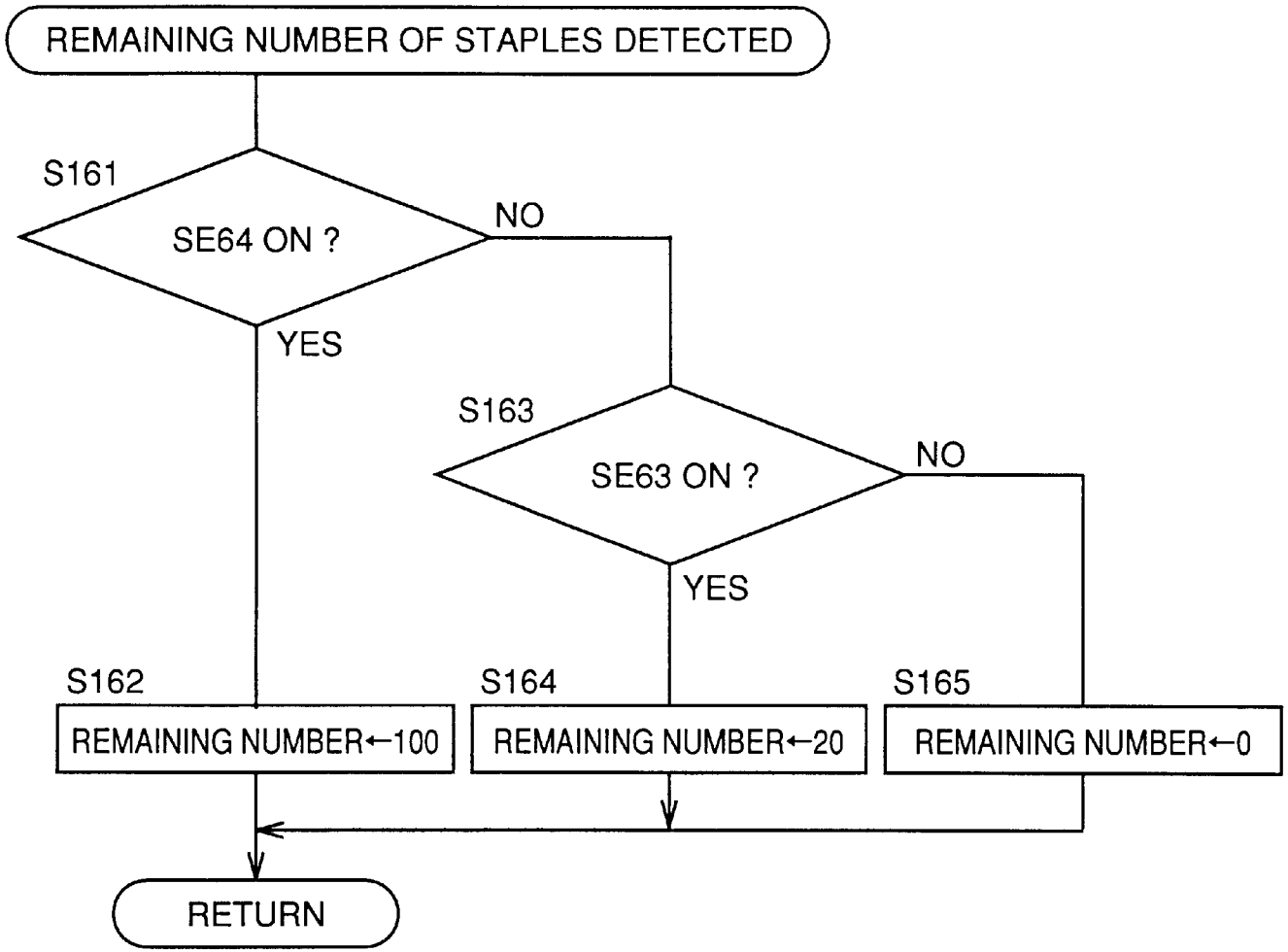
FIG. 19 is a flow chart for use in illustration of the procedure of processings in the staple remaining number detecting routine in S105 in FIG. 14.

FIG. 19 is a flow chart for use in illustration of the procedure of processings in the routine for detecting the remaining number of staples in S105 in FIG. 14. Staples in staple unit 604 are detected by sensors SE63 and SE64.

It is first determined in S161 if sensor SE64 is on. IF sensor SE64 is on (YES in S161), the remaining number of staples is set to 100 in S162, and this subroutine is completed. If sensor SE62 is off (NO in S161), it is determined in S163 if sensor SE64 is on. If sensor SE64 is on (YES in S163), the remaining number of staples is set to 20 in S164, and this subroutine is completed. If sensor SE63 is off (NO in S163), the remaining number of staples is set to 0 in S165, and this subroutine is completed.

Thus, if copying operation to all the documents is not possible, the operator can smoothly operate the apparatus.

In the above-described embodiment of the invention, several seconds are set as a time period required for a copying operation per sheet in the unit time setting routine in FIG. 10, the invention is by all means applicable to such an image forming apparatus for forming color images, which takes several minutes to copy an image per sheet.

It is noted that in the above-described embodiment, display of multiple interruption (stop) time is not particularly described, but a number of interruption time may be displayed corresponding to each remaining amount as above.

(2) Second Embodiment

Figure 20:
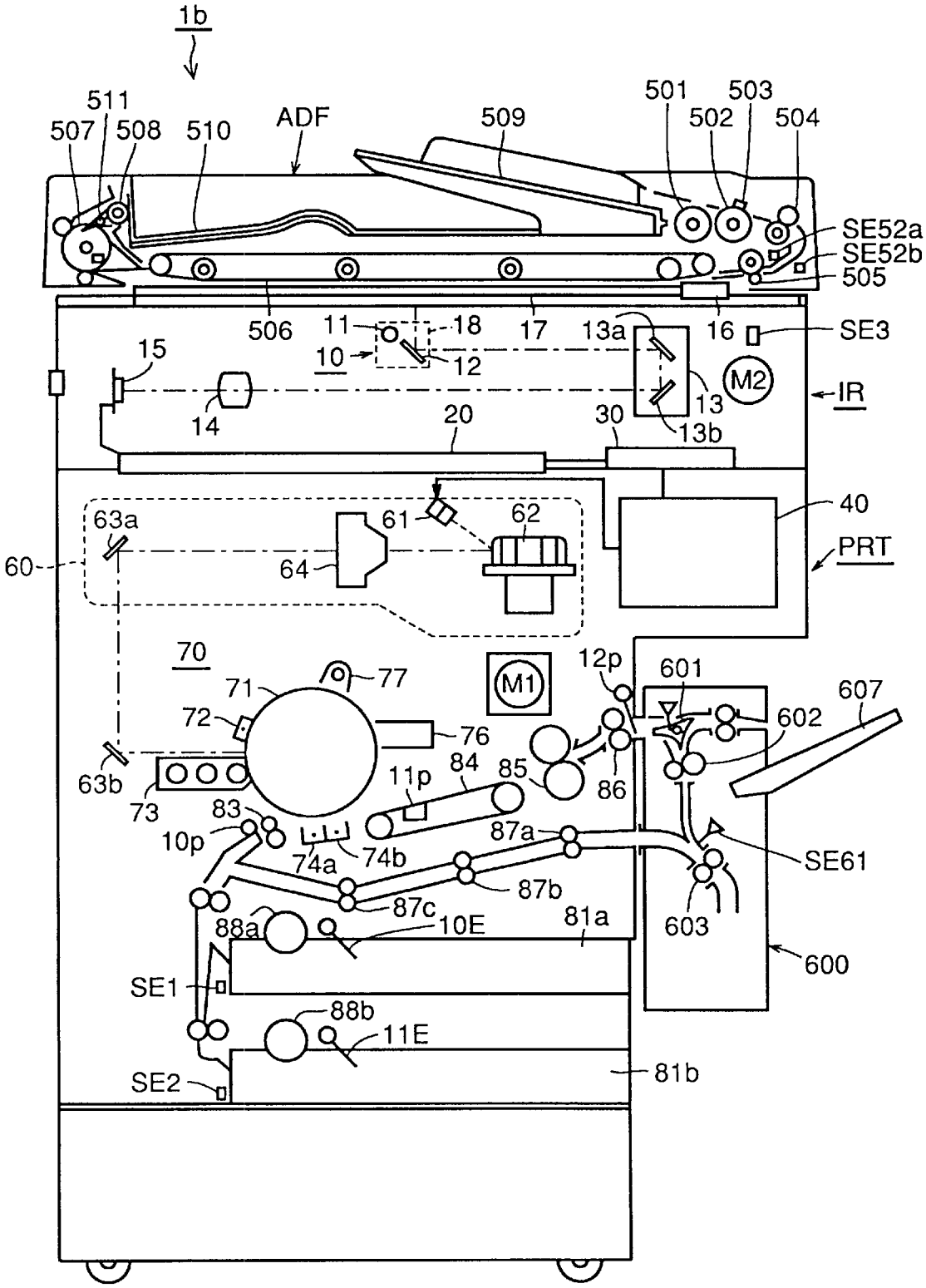
FIG. 20 is a view showing the general structure of a copying machine according to a second embodiment of the invention.

A second embodiment of the invention will be now described. FIG. 20 is a view showing the general structure of a copying machine 1*b* according to the second embodiment. Copying machine 1*b* according to the second embodiment has basically the same structure as copying machine 1 according to the first embodiment except that the structure of periphery of image forming system 70 and the arrangement of sensors are somewhat different. Therefore, the same portions as the first embodiment are denoted by the same reference characters, with their description being omitted, and different portions will be mainly described.

Referring to FIG. 20, a laser beam emitted from semiconductor laser 61 is input into a side face of photoreceptor drum 71 through two mirrors 63*a* and 63*b* excluding a mirror 63*c*.

In the periphery of photoreceptor drum 71 driven to rotate, there are provided, along the direction of rotation, a corona charger 72, a developer 73, a transfer charger 74*a*, a separation charger 74*b*, a cleaner 76, and an eraser lamp 77, and a toner image is produced by means of a well-known electrophotographic process, and transferred onto a paper sheet. Provided in the vicinity of paper feeding cassettes 81*a* and 81*b* are sheet size detection sensors SE1 and SE2 for detecting the sizes of sheets stored in the cassettes, and sensors 10E and 11E for detecting states of sheets stored in the cassettes (such as near empty and paper empty).

In the paper feeding path, there are provided sheet detection sensors for detecting the state and timing of transporting a sheet. Based on the detection of the state of the sheet detection sensor, a jamming of paper sheets can be detected. Such sheet detection sensors include a sheet detection sensor 10P positioned before the timing roller, a sheet detection sensor 11P positioned at transfer belt 84, and a sheet detection sensor 12P positioned in the downstream of the discharge roller.

A document transported by automatic document feeder ADF passes intermediate roller 504, regist sensor SE51 and a crosswise size sensor SE53, and then has its inclination corrected by regist roller 505. Immediately after the trailing edge of the document passes the left side of document scale 16, document transfer belt 506 slightly reversely rotates and stops. Thus, the right end of the document is brought into abutment against the edge of document scale 16, such that the document is set at an accurate position on document glass 17. There is such a control that the tip end of the next document has reached regist roller 505 at the time, in order to reduce time required for transporting the next document.

Figure 21:
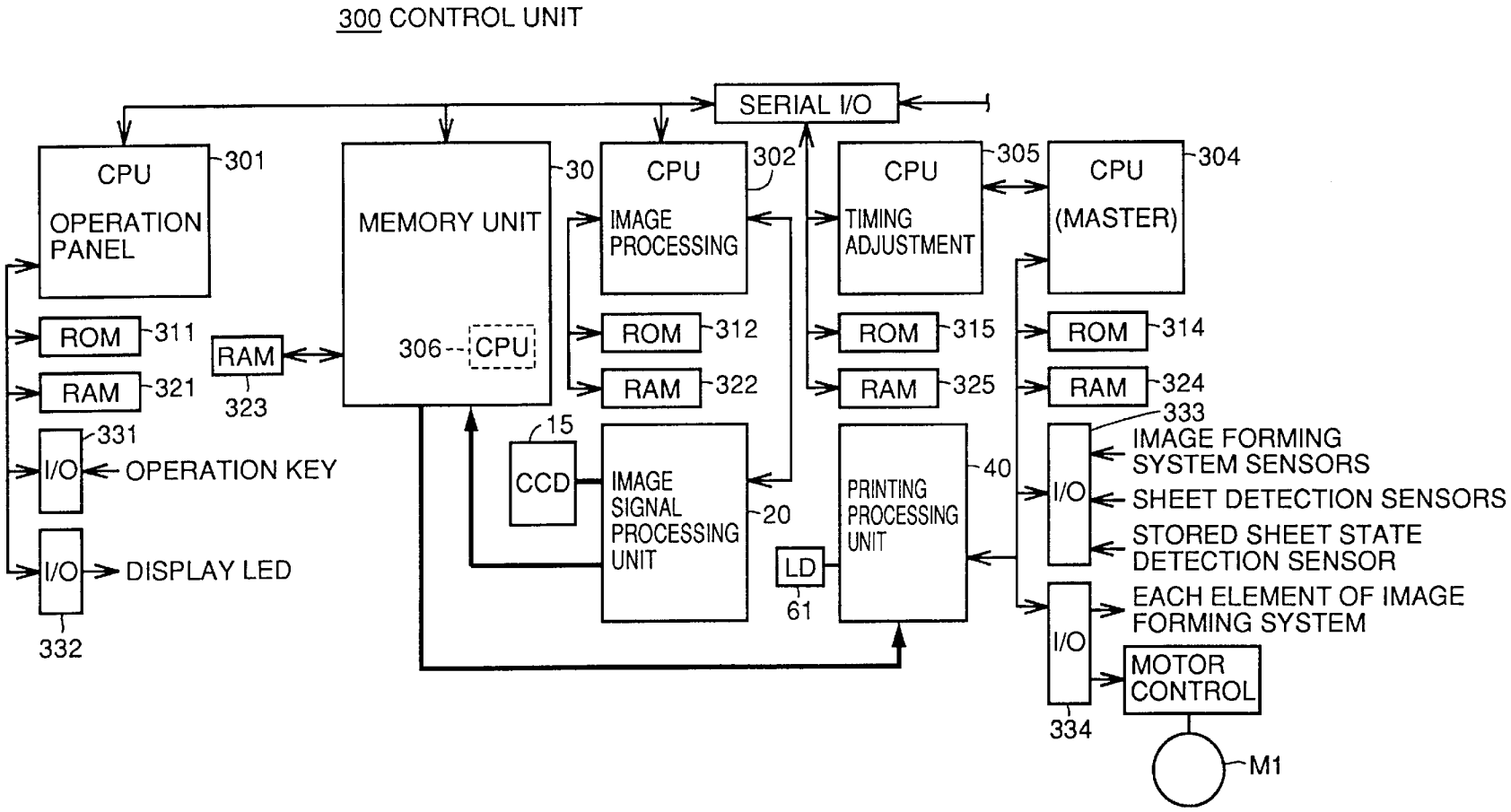
FIGS. 21 and 22 are block diagrams each showing the control unit of the copying machine according to the second embodiment.
Figure 22:
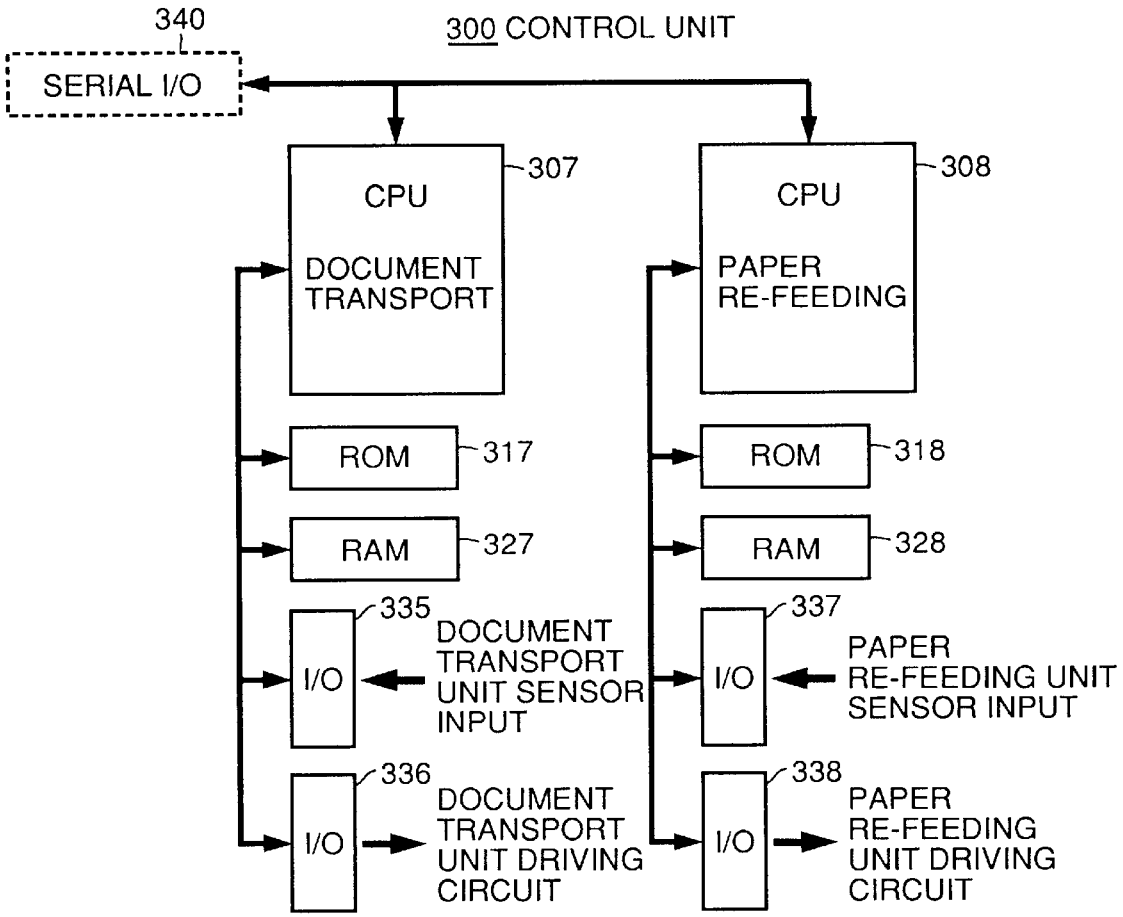

FIGS. 21 and 22 are block diagrams showing the configuration of a control unit 300 in the copying machine according to the second embodiment. The same elements as those described by referring to FIG. 20 are denoted by the same reference characters. These elements will not be repeatedly described in detail. Referring to FIGS. 21 and 22, control unit 300 is mainly formed of seven CPUs (Central Processing Units) 301 to 307, which are provided with ROMs (Read Only Memories) 311 to 317 storing programs, and RAMs (Random Access Memories) 321 to 327 serving as work areas for executing these programs. Note that CPU 303 is provided in memory unit 30.

Since each CPU, ROM and RAM operates basically in the same manner as the first embodiment, the description of the same operation portions will not be described here.

CPU 303 controls memory unit 30 to temporarily store read image into an image memory 304 which will be described in conjunction with FIG. 5 and reads out the data for output to printing processing unit 40. Signals from sheet size detection sensors SE11 and SE12 are input to an input/output portion controlled by CPU 104, and the size of copy sheets is controlled by CPU 104. CPU 104 monitors, through the input/output portion, the state of detection by sheet detection sensors 10P, 11P and 12P, and the states of detection of sheet state detection sensors 10E and 11E. CPU 106 controls document transportation by automatic document feeder ADF. CPU 107 controls paper re-feeding unit 600.

Figure 23:
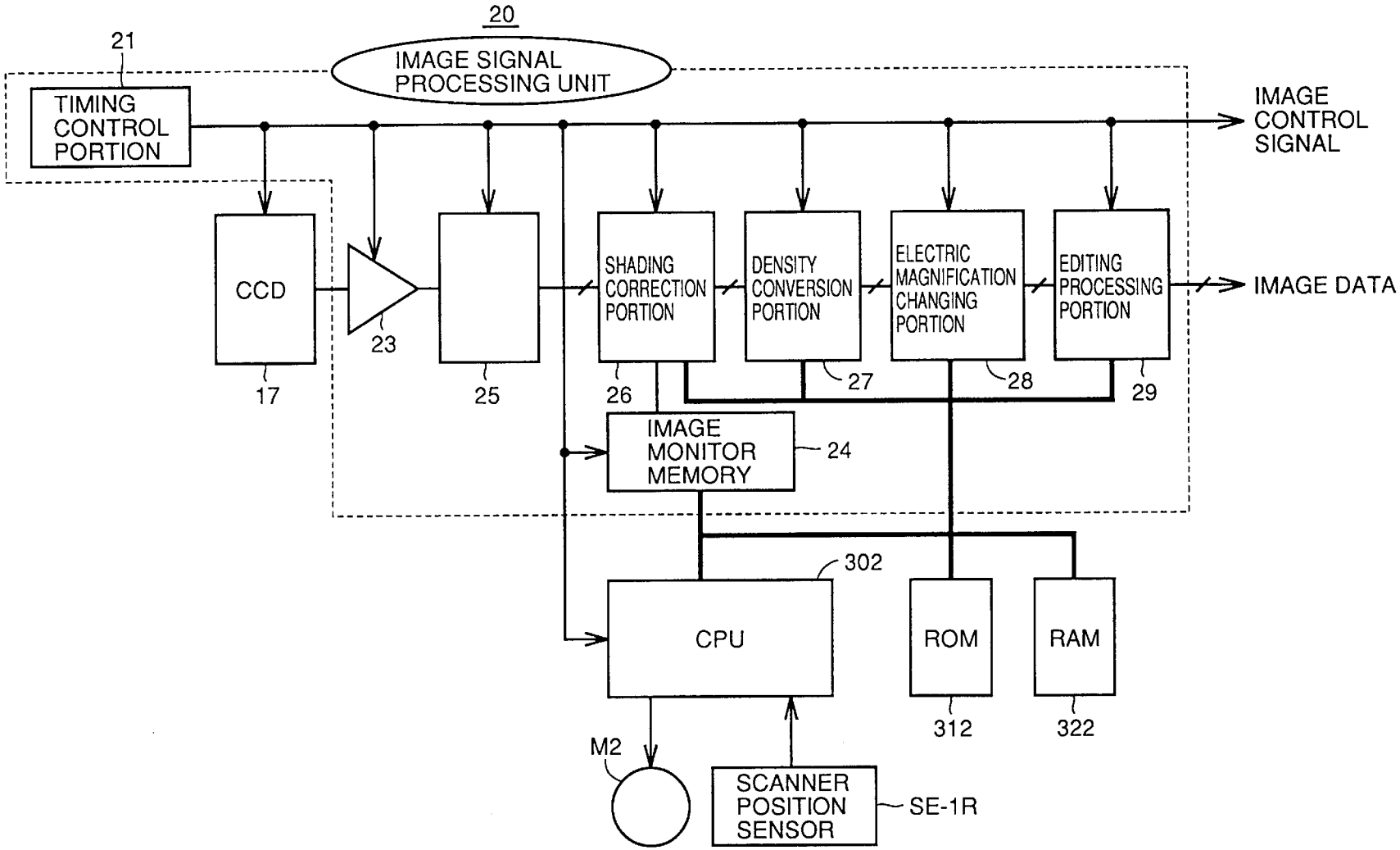
FIG. 23 is a block diagram showing the image signal processing unit of the copying machine according to the second embodiment.

Image signal processing unit 20 will be now described in detail. FIG. 23 is a block diagram showing image signal processing unit 20 in the copying machine according to the second embodiment. The same elements as those described by referring to FIGS. 20 and 21 are denoted by the same reference characters. These elements will not be described in detail here.

An image reading synchronizing signal is supplied to each block from a timing control unit 21. A CCD 17 photoelectrically converts document information into an electrical signal. The signal is amplified and controlled by an amplifier unit 23, and converted into a 8-bit digital signal by an A/D (Analog/Digital) converter 25. The signal is removed of distortion caused by the optical system or the CCD by a shading correction unit 26. A density conversion unit 27 then converts the reflection data into density data, followed by the processing of correcting gamma. The resulting signal is input into an electrical magnification changing unit 28, and subjected to an electrical magnification changing processing in the main scanning direction according to set magnification information. Then, an editing processing unit 29 further edits the signal to produce image data for supply to memory unit 30.

An image monitor memory 24 stores image data on a 1-line basis in response to an instruction from CPU 302. CPU 302 controls the entire image signal processing unit 20 including controls of setting parameters to shading correction unit 26, density conversion unit 27, electrical magnification changing unit 28, and editing processing unit 29, and scanning by driving by scanner motor M2, and communication with CPU 305.

Now, detection of a document size and detection of if a document is placed longitudinally or laterally will be described. For example, the document cover is assumed to have a mirror surface as a document is scanned, and the part with a larger amount of reflected light is determined as the document. Since the mirror surface has almost no reflected light, the determination can be easily made.

CPU 302 performs preliminary scanning upon receiving an instruction of detecting the document size from CPU 305. CPU 302 controls scanner motor M2 based on scanner position information from a scanner position sensor SE-IR, and controls the scanner to scan the document in the subscanning direction. The document size and if the document is placed longitudinally or the laterally are detected based on the content of image data and monitor position information in the timing corresponding to the subscanning position, and the result of detection is transmitted to CPU 305.

CPU 302 controls the speed of scanner motor M2 corresponding to magnification information transmitted from CPU 305 at the time of reading the image.

Figure 24:
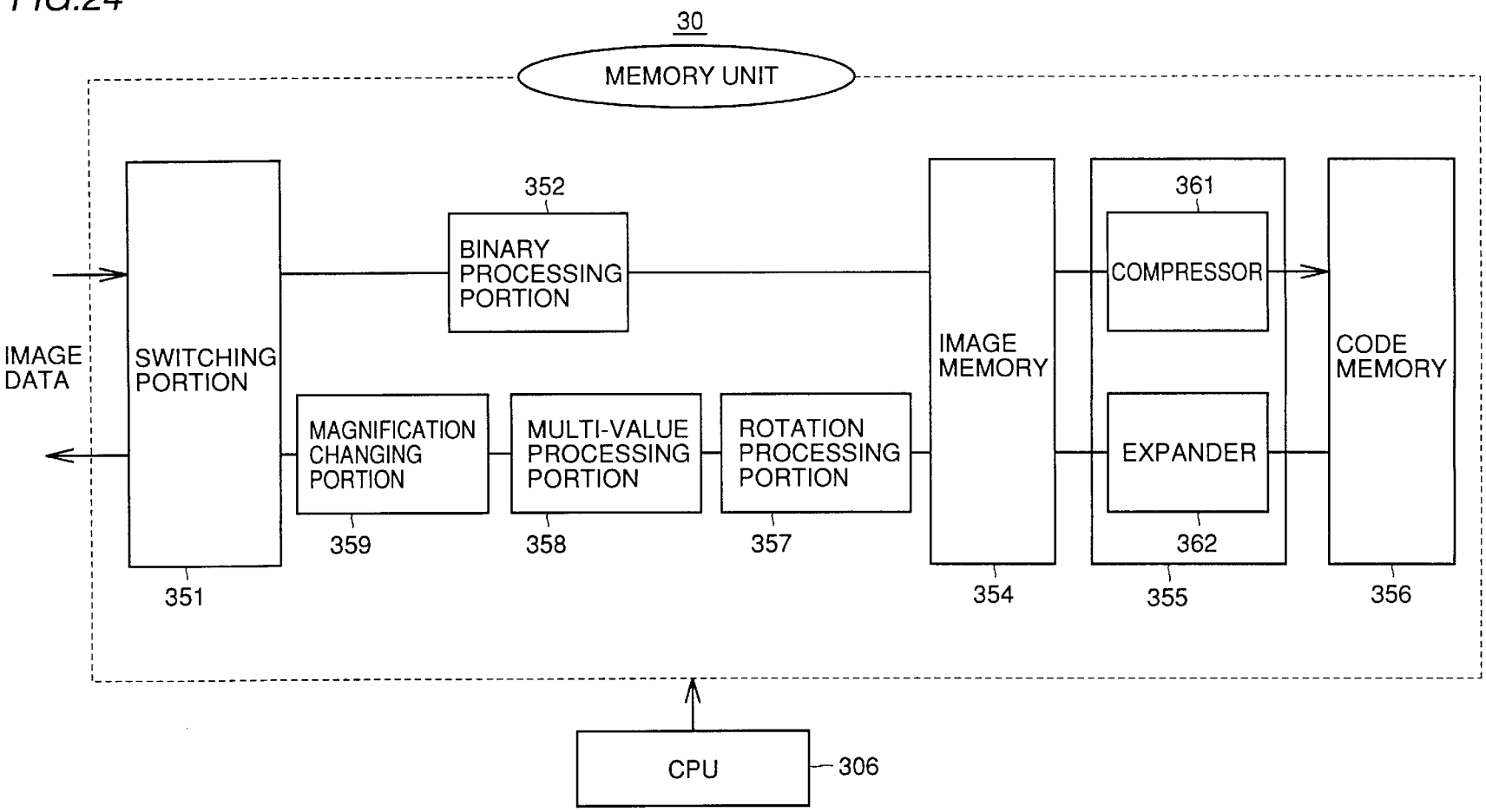
FIG. 24 is a block diagram showing the memory unit of the copying machine according to the second embodiment.

Now, the configuration of memory unit 30 will be described in conjunction with FIG. 24. Memory unit 30 includes a switching portion 351, a binary processing portion 352 for producing binary data, a multi-port image memory 354 having a capacity for two pages of A4-size sheets at 400 dpi, a code processing portions 355 having independently operable compressor 361 and expander 362, a multi-port code memory 356, a rotation processing portion 357, and a multi-value processing portion 358 for producing multi-value data based on parameter setting from CPU 303, a magnification changing processing portion 359, and a CPU 303 controlling all these elements.

Code processing portion 355 reads out image data written in image memory 354, produces code data by compressing the data by compressor 361, and writes the result into code memory 356. Then, the code processing portion reads out code data written in code memory 355 in response to an instruction from CPU 303, produces image data by expanding the read out data by expander 362 and writes the result into image memory 354.

Once image data for 1 page is produced by expansion and stored into image memory 354, CPU 303 calls the image data from image memory 354, and supplies the data into rotation processing portion 357. Rotation processing portion 357 rotates the image data as required, multi-value image data is produced in multi-value processing portion 358, and the data is output through magnification changing processing portion 359. Magnification changing processing portion 359 can electrically change magnifications in the main and sub directions. Note that compressor 361 and expander 362 can operate independently from each other and in parallel. Between these devices and code memory 356, data is DMA (Direct Memory Access)-transferred. During temporarily storing such document images, code memory 356 is controlled by a management table MT1 provided within RAM 323 which will be described. CPU 303 controls these elements.

Figures 25A, 25B:
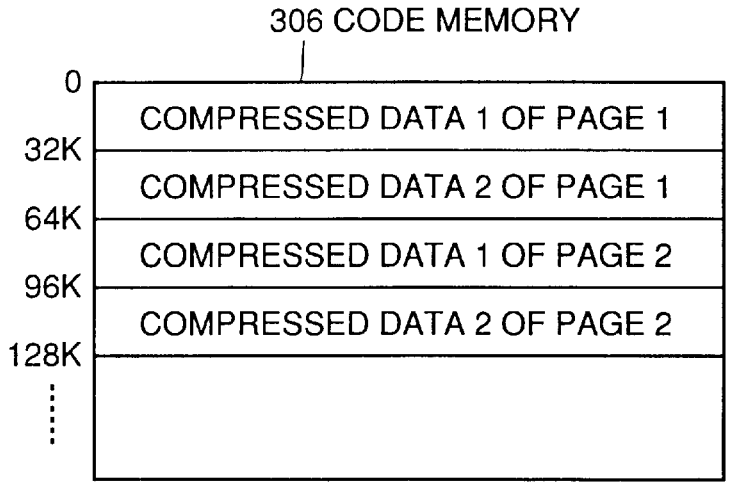
FIGS. 25A and 25B are management tables for the copying machine according to the second embodiment.

FIGS. 25A and 25B are management tables for the copying machine according to this embodiment. Referring to FIGS. 24, 25A and 25B, code memory 356 is divided into 32-kilo byte unit memory regions, and code data per page is stored in each region for the purpose of enabling simultaneous control of writing (while reading a document) and reading (while printing).

Management table MT1 stores numbers representing regions in code memory 356, page numbers (the numbers of document images) PN for supplied image data in the order or writing (in the order of scanning documents), the number of regions coupled therewith, the number of image registration, various additional information necessary for compression/expansion processings such as the method of compression and data length, and CPU 303 dynamically controls code memory 356 based on these kinds of information.

"Forward concatenation" in FIG. 25A represents the connection of a region for 32 kb in the forward direction in each page. "00" indicates that the region is the first storage region of data for one page. "Rearward concatenation" similarly represents the connection of a region for 32 kb in the rearward direction in each page. "FF" indicates that the region is the last region, and the others each indicate the number of the region connecting that region in the rearward direction.

CPU 303 controls compressor 311 and stores image data read out from image memory 354 by referring to information in management table MT1 as shown in FIG. 25B. During outputting image data, code data is read out from code memory 356 in the operation opposite to the above. Information in management table MT1 is erased once information for a corresponding page has been normally read out and the number of copies N specified by the operator has been completed.

Figure 26:
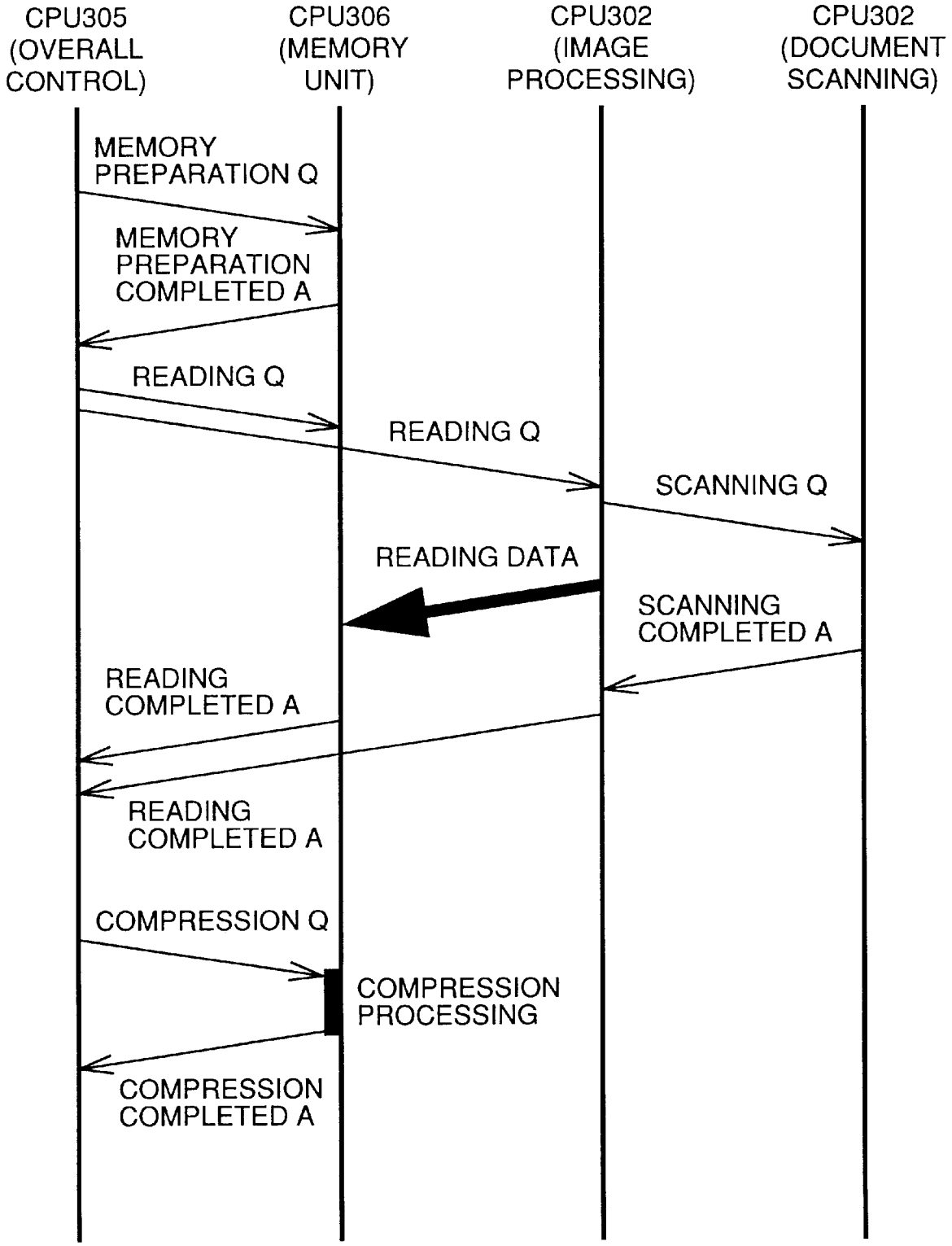
FIG. 26 shows a memory writing operation by the copying machine according to the second embodiment.

The flow of request commands (Q), reports (A) and data exchanged between the CPUs in the operation sequence of copying machine 1*b* will be now described. FIG. 26 is a diagram showing the memory writing operation of the copying machine according to this embodiment. In a writing operation, image data is transferred from image signal processing unit 20 to image memory 354. Referring to FIG. 26, CPU 305 controlling the entire sequence requests CPU 303 to make the memory ready. CPU 303 in response performs various settings including setting the state of bus connection to the internal hardware for the purpose of transferring image data from image signal processing unit 20 to image memory 354, setting a mode for binary processing, and setting the starting address of a writing region to image memory 354 and XY length information.

When the memory is ready after these settings, CPU 303 notifies CPU 305 of the completion of memory preparation. When CPU 305 requests CPU 303 and CPU 302 of reading, the control unit of CPU 302 requests its internal document scanning portion to scan. Thus, the document scanning control unit starts scanning, and once the scanner reaches the image region, read data (image data) is transferred from image signal processing unit 20 to memory unit 30 based on the image processing mode set by CPU 302.

When notified of the completion of reading from CPU 302 and CPU 303 after the scanning, CPU 305 requests CPU 303 to compress the data. CPU 303 sets a reading address from image memory 354, XY length information, a writing address to code memory 356, and the mode of compressor 311 (such as arithmetic encoding method), and activates each element. Thus, a compressing processing is performed to store the code data into code memory 356. Once the compressing processing is completed, CPU 305 is notified of the completion of compression by CPU 303.

FIG. 27 is a diagram for use in illustration of a memory reading operation by the copying machine according to the second embodiment. Referring to FIG. 27, image data is read out from image memory 354 in a memory reading operation, and a copy image is printed onto a paper sheet based on the image data.

CPU 305 requests CPU 303 to expand data. CPU 303 sets a reading address from code memory 356, the amount of data, a writing address to image memory 354, XY length information, and the mode of expander 362, and activates. each element. Thus, an expansion processing is performed and image data is written into image memory 304.

After the expansion processing, CPU 305 requests CPU 303 to make image memory 354 ready for reading of image data. CPU 303 sets to the internal hardware the state of bus connection to output image data from image memory 354 to printing processing unit 40, the starting address of a reading region in image memory 354, and XY length information. When notified of the completion of the preparation after these settings are completed, CPU 305 requests CPU 303 and printing processing unit 40 to print. A paper feeding report informing CPU 305 of the state of transportation of sheets is sent from print processing unit 40, and image data read out from image memory 305 is then output to printing processing unit 40 for printing.

After the printing is completed, CPU 303 and printing processing unit 40 send a printing completion report and an eject completion report to CPU 305. Once receiving these reports, CPU 305 transmits a memory clear request to CPU 303 if necessary.

FIG. 28 is a view showing the operation panel of the copying machine according to the second embodiment. Referring to FIG. 28, the operation panel according to the second embodiment includes a liquid crystal touch panel 91 for displaying states and setting various modes, a ten key 92 for inputting a numerical condition for copying (such as the number of copies and magnification), a clear key 93 for returning the set numerical condition to standard values, a panel reset key 94 for initializing a set copy mode, a stop key for instructing stopping of copying, a start key 96 for instructing starting of copying, a document specification key 100 for specifying either a single-sided document or a double-sided document, a copy mode key 99 for switching between double-sided copying and single-sided copying, a document reading start key 110 for starting reading of the next user document during outputting an image, a document reading stop key 111 for stopping only reading of a document, and a registration key 112 for registering the read documents (a set of jobs) to the memory.

Liquid crystal touch panel 91 displays the near empty and empty states of stored page sheets, the occurrence of a jamming of sheets, troubles such as a driving fault of the motors/the fixation heater fault.

Figure 29:
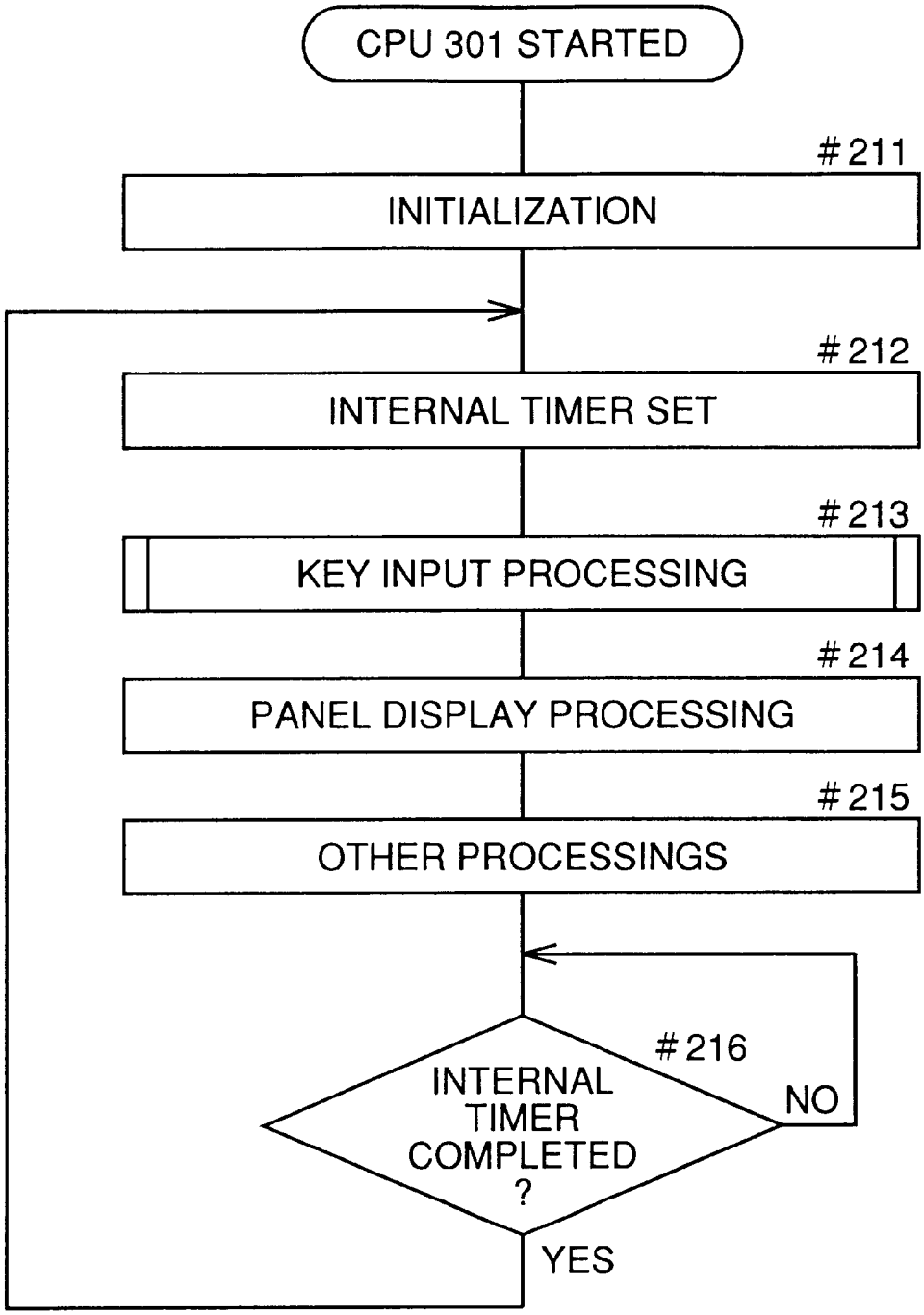

FIGS. 29 to 32 are flow charts for use in illustration of the procedure of processings by CPUs in the copying machine according to the second embodiment. FIG. 29 shows a main flow chart for CPU 301 controlling the operation panel. Once the power supply is turned on, CPU 301 initializes RAMs, registers and the like (S211, followed by the processing of setting the internal timer to define the length of one routine (S212), a key input processing to accept a key operation (S213), a panel display processing for making a display corresponding to the operation (S214), the other processings (S215), and a confirmation processing for the time up (expiration) of the internal timer (S216), and these processings are repeatedly performed. Communication with the other CPUs is performed as an interruption processing from time to time.

Figure 30:
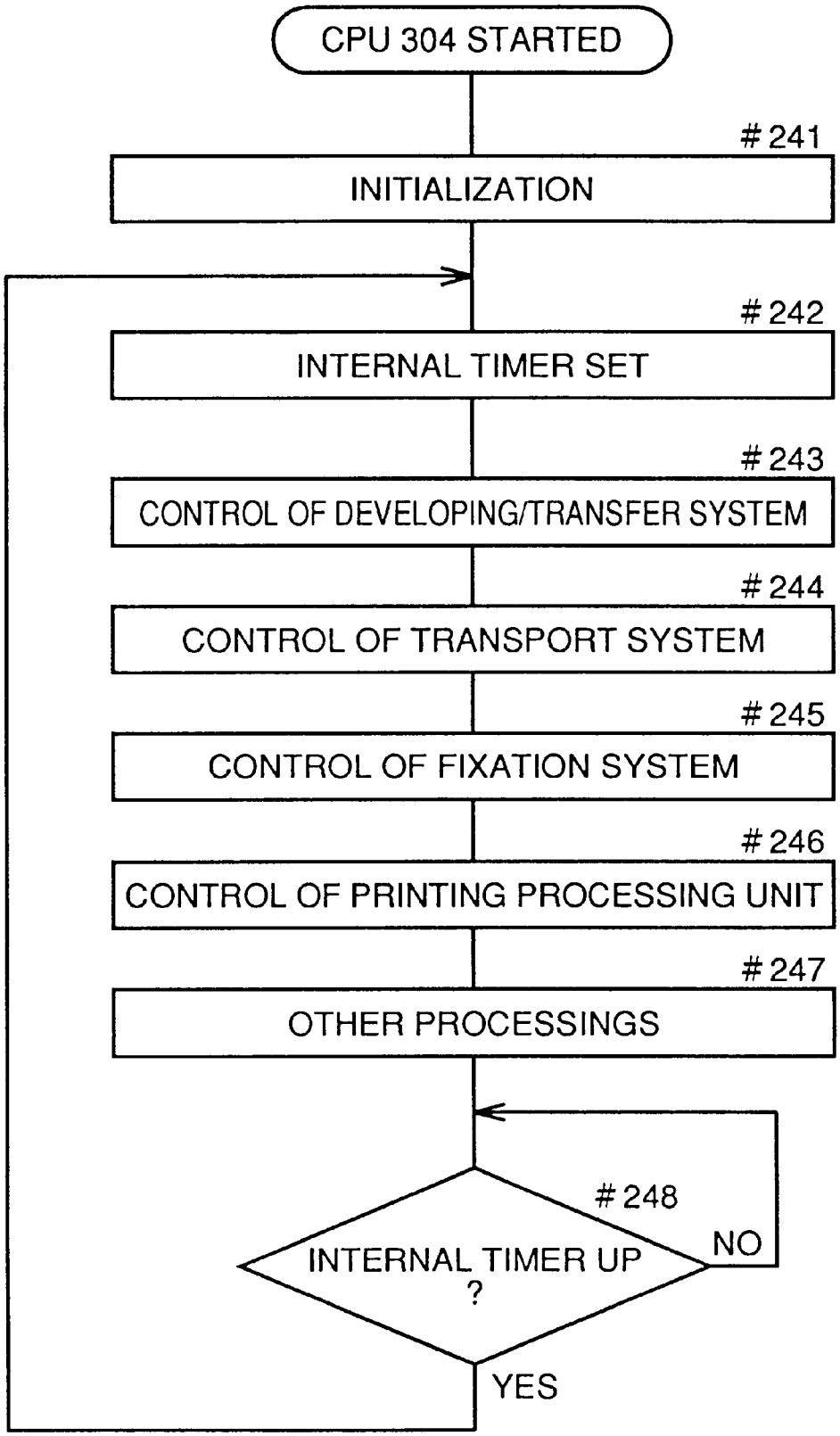

FIG. 30 shows a main flow chart for CPU 304 controlling printer P. Referring to FIG. 30, CPU 304 performs an initialization processing (S241), and then repeatedly performs the setting processing of the internal timer (S242), the processing of controlling the development/transfer system (S243), the controlling processing of the transport system (S244), the control processing of the fixation system (S245), the control processing of the printing processing unit (S246), the other control processings (S247), and the timer up confirmation processing of the internal timer (S248).

A jamming of sheets is detected in the control processing of the transport system (S244). Detection of a trouble such as a heater fault of the fixation heater is performed in the control processing of the fixation system (S245). Detection of near empty and empty by detecting the remaining amount of stored sheets is performed in the other processings (S247). In addition, in the other processings (S247), power supply-off control is performed, and power supply-off request information is transmitted to the other CPUs. Note that the output interval control which will be described is performed in the control processing of the transport system (S244). Information on the state of job registration in code memory 356 is sent from CPU 303 through the communication line.

The processing of detecting stored sheets is performed in the other processings (S247).

Figure 31:
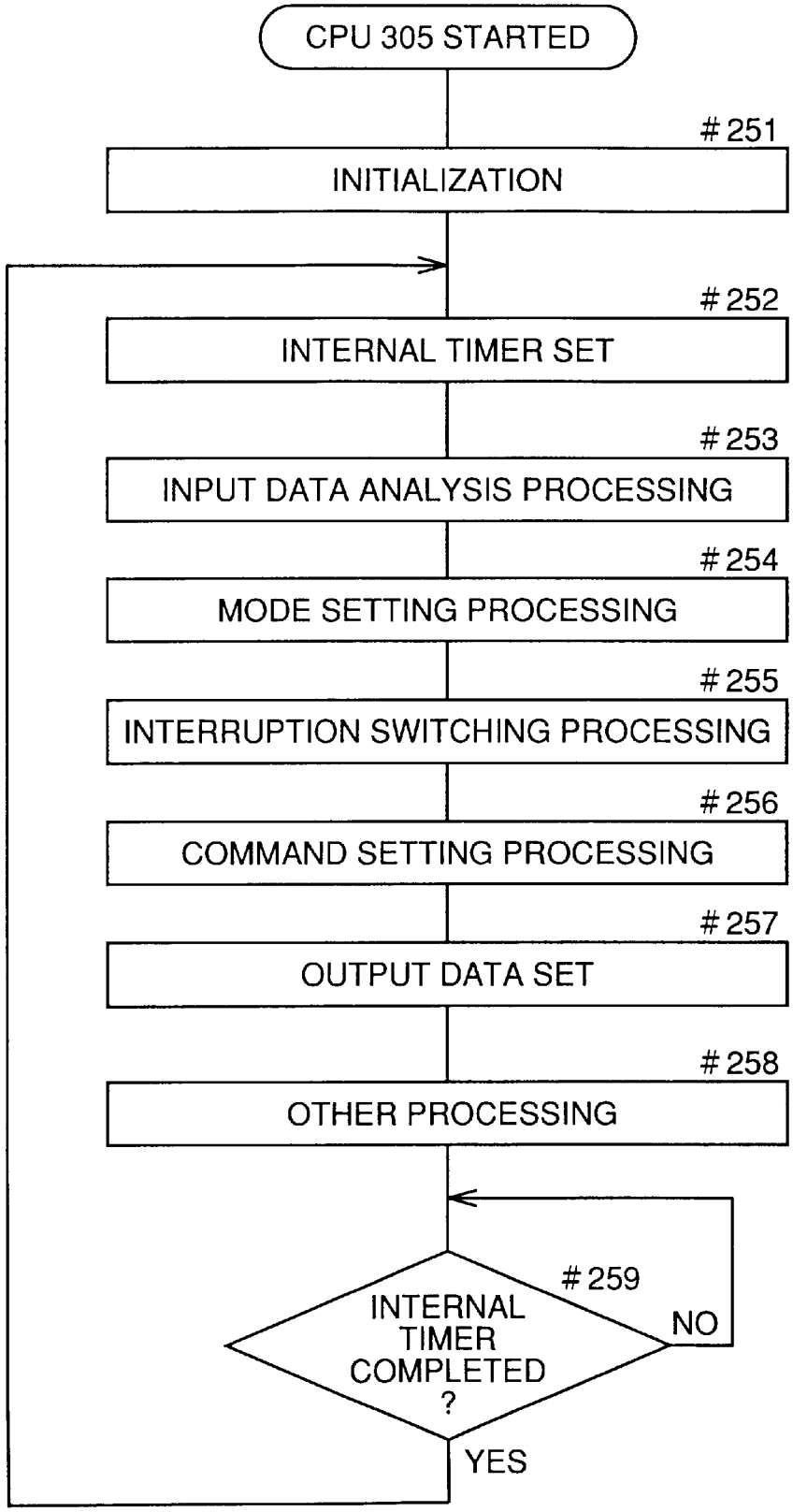

FIG. 31 shows a main flow chart for CPU 305 which governs control of the copying machine. Referring to FIG. 31, CPU 305 performs the initialization processing (S251), and then repeatedly performs the processing of setting the internal timer (S252), the processing of input data analysis to check input data from the other CPUs (S253), the processing of setting a mode to set an operation mode according to the content of the operation (S254), the processing of interruption switching (S255), the processing of command setting (S256) for setting a command corresponding to the mode, the processing of setting output data to make a command stand by at the communication port (S257), the other processings (S258), and the processing of confirming the time up (expiration)of the internal timer (S259).

Figure 32:
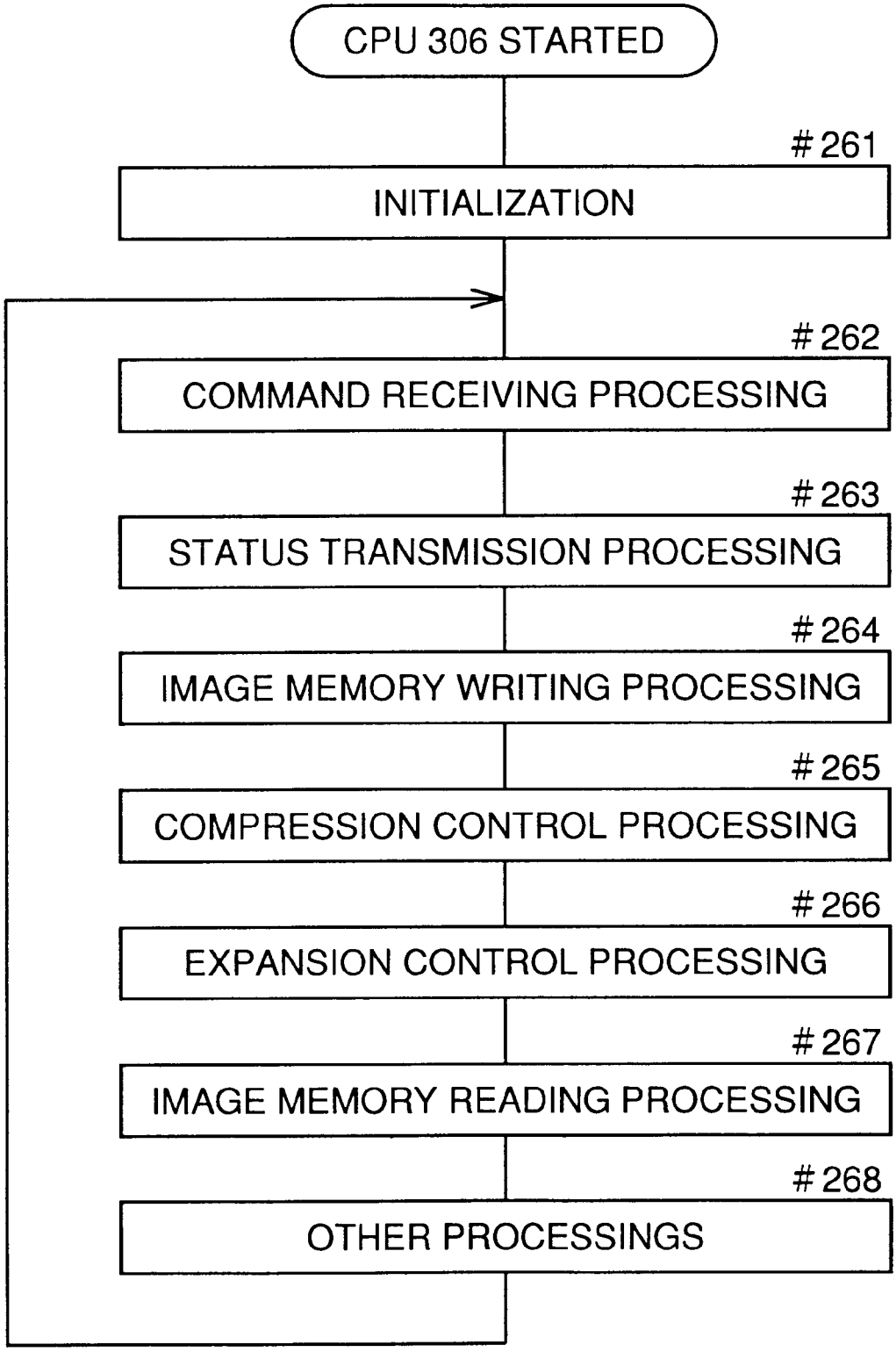

FIG. 32 is a main flow chart for CPU 303 which controls memory unit 30. Referring to FIG. 32, CPU 303 performs the processing of initialization (S261), and repeatedly performs a command receiving processing (S262), a status transmission processing (S263), an image memory writing processing (S264), a compression control processing (S265), an expansion control processing (S266), an image memory reading processing (S267), and the other processings (S268).

Referring to FIGS. 33 to 35, a warning of the occurrence of paper empty will be now described. FIGS. 33 and 34 are flow charts for use in illustration of the procedure of processings in a paper empty warning processing by the copying machine according to this embodiment. FIG. 35 is a view showing how a paper empty warning is displayed by the copying machine according to the second embodiment.

Referring to FIG. 33, this processing is executed as the processing of CPU 304 as described in conjunction with FIG. 30 and the other processings (S247). The status of a copying operation is first determined (S300). If the content of the copying operation is "none", the other processings (S306) are executed and completed. If the status of the copying operation is "start" (a status set when a copying operation is started), various kinds of information necessary for determining the number of sheets such as single/double-sided document, single/double-sided copy, Nin1 (data for how many documents will be formed in one page of sheet) are stored (S301). Then, the number of copies input through the operation panel is stored (S302). Then, the status of the copying operation is changed to "continuation" (S303). Then, after executing the other processings, the processing is completed (S306). If the content of the status of the copying operation is "continuation", it is determined if the number of documents has been determined (S304). This operation corresponds to determining the number of documents which constitute a job at the time of the completion of reading of all the documents in the job. If the number of documents has been determined, a paper feeding cassette checking processing is performed (S305). If the number of documents has not been determined, the other processings are executed (S306), and the processing is completed.

In the paper feeding cassette checking processing, the number of sheets necessary for copying the job is calculated (S400) according to the following formula.

(Necessary Sheet Number)=(((Document Number) * (Document Plane Number)/N)/Printing Plane Number) wherein a fraction in a calculation result is raised.

N represents the number of documents whose copy should be formed onto a sheet of printing paper at Nin1.

The number of document planes represent to the number of planes in which images are formed in a document. If, for example, an image is formed on both planes of a document, the number of document planes is "2", while if an image is formed only on one side of a document, the number of document planes is "1".

The number of printing planes refers to the number of planes of a printing sheet onto which document images are copied. For a double-sided copy, for example, the number of printing planes is "2", and for a single-sided copy, the number of printing planes is "1".

The necessary number of sheets resulting from the above formula corresponds to the number of sheets necessary number per copy for a certain job, in other words the necessary number when the operator sets 1 as the number of copies on the operation panel, and the above formula should be actually multiplied by the number of copies set by the operator on the operation panel as follows.

(Necessary Sheet Number)=(Necessary Sheet Number Per Copy) * (Number of Copies)

Note that in this embodiment, the operation of reading an image and storing the data of the image into the memory is simultaneously performed with the operation of sequentially reading out data stored in the memory for printing. Therefore if there are a large number of documents for a job, a printing operation to the first document might have been completed and the printed sheet might have discharged outside or feeding of a sheet is in progress for a printing operation to the first document, when all the documents have been read.

Therefore, to cope with such a case, the necessary number of sheets must be corrected by subtracting the number of sheets being fed or having been discharged, and the number of sheets which will be necessary at the point of the completion of reading is accurately produced (S401). Then, the remaining amount of sheets in a paper feeding cassette sent from CPU 304 and the produced necessary number of sheets are compared (S402). Herein, the remaining number in the feeding cassette refers to the number produced by adding up the remaining number of sheets in a paper feeding cassette presently selected, and the remaining number in other feeding cassettes storing sheets in coincidence with the sheets in the presently selected paper feeding cassette in terms of sheet size, direction and attribute (such as front sheet/paper feeding cassette/backside copying prohibited sheet/recycled sheets). The remaining number and the necessary number are compared, and if a shortage of sheets is detected (S402), a status called "necessary sheet shortage" is set (S403). If such a shortage is not detected, or the status of "necessary number shortage" is set (S403), the copying operation status is set to "none", (S404), and the paper feeding cassette checking processing is completed.

The status of the necessary number shortage is transmitted to CPU 301 (operation panel) by the processing of setting output data (S257) in the main flow chart for CPU 105 described in conjunction with FIG. 31.

The operation panel upon receiving the status of the necessary number shortage controls CPU 301 to make a warning display for paper empty as shown in FIG. 35 in liquid crystal touch panel 11, thus attracting the attention of the operator to supplement sheets required.

The operator therefore can supply necessary sheets before leaving the apparatus with the documents, he/she does not have to worry about the occurrence of paper empty when leaving the place with the documents. As a result, a copying machine with improved operability which can sequentially and automatically output all the received documents is provided.

The copying machine can accept a plurality of jobs at a time. The machine determine whether or not it is necessary to issue a warning when a new job is input and issues the warning if necessary.

FIG. 36 is a flow chart for use in illustration of the procedure of processings in the processing of detecting the state of stored sheets in the copying machine according to this embodiment. The processing is executed in the other processings (S247) in the main flow chart for CPU 304. When the processing of detecting the state of stored sheets is entered, the states of stored sheet state detection sensors 10F and 11E are confirmed (S700). Then, the processing of, detecting a near empty state for stored sheets is executed (S800), which will be described later. Thereafter, the processing of detecting an empty state is executed (S900), thus completing the subroutine.

FIG. 37 is a flow chart for use in illustration of the procedure of processings in the processing of detecting the near empty state of the copying machine according to the second embodiment. The processings are examples of various processings in the near empty detection processing (S800) shown in FIG. 36. When the near empty detection processing subroutine is entered (S800*a*), the sheet size necessary for a job being presently printed and the necessary number of sheets produced according to the above-given formula (S400 in FIG. 34) are obtained from CPU 303 (S802*a*). Then, the necessary number of sheets for each job is compared with the size and remaining number of sheets presently stored in the paper feeding cassettes of the copying machine based on the size information, and it is confirmed if a shortage of sheets will take place until the end of printing of each job (S804*a*).

If it is determined that there will be no such shortage (YES in S804*a*), the output interval extension request flag is set to "0" (S806*a*), thus completing the subroutine.

Meanwhile, if it is determined that there will be a shortage of sheets (NO in S804*a*), the output interval extension request flag is set to "1", in other words the output interval is prolonged (S808*a*), thus completing the subroutine.

The output interval extension request flag is a request flag to extend the interval of feeding of sheets to be processed in the copying machine and "0" in the flag indicates that there is no such request, and "1" indicates that there is a request. The flag is set to "0" in the initial state. The flag is used in the output interval control processing which will be described in conjunction with FIG. 38.

FIG. 38 shows a flow chart for use in illustration of the procedure of processings in the output interval control processing. The processing is executed as one subroutine among control of the transport system (S244), which is one subroutine in the main flow chart for CPU 304 which controls the printer unit as described in conjunction with FIG. 30. When the output interval control processing (S808) is entered, it is determined if the output interval extension request flag as described in conjunction with FIG. 37 is set to "1" (S8081). If the output interval extension request flag is set to "0" (NO in S8081, the interval of feeding of sheets is set to a prescribed value (S8082), thereafter, the subroutine is completed. As the initial value of the interval, a prescribed value of for example 100 mm is set. The interval of feeding is the distance between the trailing edge of a sheet and the forward end of the next sheet. It is represented in distance herein, it may be represented in time corresponding to the distance, because the speed of transporting sheets is usually fixed.

Meanwhile, if the output interval extension request flag is set to "1" (YES in S8081), the interval is set to a value larger than the prescribed value such as 200 mm and 300 mm (S8083), and the subroutine is completed. If the interval of feeding of sheets (also referred to a "sheet interval") is increased, the overall speed of processing for discharging output sheets with images formed thereon is lowered. In other words, the output speed may be lowered. Note that the interval of feeding of sheets when the output interval extension request flag is set to "1"is not limited to 200 mm or 300 mm, and may be set to any value which brings about the same effects as the present invention.

FIG. 39 is a flow chart for use in illustration of the procedure of processings the power supply off control processing in the copying machine according to this embodiment. The processings are executed in the other processings (S247) of CPU 304 as described in conjunction with FIG.

30. When the power supply off control processing is entered, it is determined if the apparatus is in a printing stop state (S1200). The printing stop state refers to a stand-by state after all the output processings are completed, and an output interrupted state because of paper empty, a trouble in the apparatus and a jam. If it is determined that the apparatus is not in the stop state (S1200), the state is set to "0" (S1210). Then, the power supply off timer is stopped, and the value is cleared (S1215). After the power supply off request is cleared (S1200), the subroutine is completed. The state is set depending upon the condition of operation of the power supply off timer. If the timer is not operating, "0" is set, and when the time is operating, "1" is set.

Meanwhile, if it is determined that the apparatus is in the stop state (S1200), it is determined if there is a key operation by the user to the operation panel (S1205). If there is a key operation to the operation panel, the state is set to "0" (S1210). Then, the power supply off timer is stopped, and the value is cleared (S1215). After clearing the power supply off request (S1220), the subroutine is completed.

If it is determined that there is no key operation (S1205), the state is confirmed (S1225). Note that when the power supply is turned on, it is initialized to the state of "0" in other processings.

Meanwhile, if it is determined that the state is set to "0" (S1255), the power supply off timer is started (S1230), and the state is set to "1" (S1235), and then subroutine is completed.

If it is determined that the state is set to "1"(S1225), it is determined if the value of the power supply off timer is smaller than a prescribed value (S1240). If the timer value is determined smaller than the prescribed value (S1240), after counting up of the power supply off timer (S1245), the subroutine is completed. If the timer value is determined larger than the prescribed value, a power supply off request is issued (S1250), and the subroutine is completed.

When the power supply off request is issued after the above processings, the power supply of the apparatus is turned off in a power supply control processing unit which is not shown. Once the power supply is turned off by the power supply control processing unit, the registered content of jobs stored in code memory 306 are erased.

FIG. 40 is a diagram for use in illustration of the output interval extension operation in the copying machine according to this embodiment. The abscissa in FIG. 40, represents the time range. Note that FIG. 40 corresponds to the case in which the remaining number of sheets in a paper feeding cassette is smaller than the necessary number of sheets in a job in printing.

The upper part in FIG. 40 is an example of a conventional operation. Assume that a near empty state of sheets, 20 sheets remaining, for example is detected at point A in a printing operation. In the conventional operation example, if a near empty state is detected, the output interval extension control is not performed, an empty state of sheets is attained at point B, in other words after printing the 20-th sheet as the operation continues, and the apparatus stops operating at that point. If the apparatus which thus stopped operating is left in. the state, and the operator does not return, a mode to turn off the power supply of the apparatus is operated at point C, 120 minutes after the operation of the apparatus is stopped for example, and the power supply is turned off. As a result, information stored in the memory is erased.

The lower part in FIG. 40 corresponds to an example of the operation of the copying machine according to this embodiment. Assume that a near empty state of sheets is detected at point A' during printing. The above A and A' are in the same timing. In this embodiment, when such a near empty is detected, the output interval extension control to prolong the interval of feeding of sheets is performed. More specifically, the interval of feeding of sheets is increased for the 20 sheets remaining after the near empty is detected, so that the speed of operation unit each sheet is discharged is lowered. Therefore, an empty state of sheets is attained at point B' far delayed from the above point B if the apparatus continues operating in the state and the operator does not return. Then the apparatus stops operating. If the apparatus is left in the state and the operator does not return, a mode to turn off the power supply of the apparatus is operated at point C', 120 minutes after point B'. As a result, information stored in the memory is erased. The time period between points B and C and the time period between points B' and C' are the same 120 minutes.

Starting from points A and A', in the case of this embodiment, the time period between point A' and point C' is greatly larger than the time period between points A and C. More specifically, the time until the power supply is turned off and information stored in the memory is erased is prolonged, and therefore the operator has more chances to return to check the state of the copying machine. This leads to the prevention of erasure of information stored in the memory, which is shown in the lower right portion in FIG. 40.

In this example, the operator returns to the apparatus to check the state of the apparatus at point D where the apparatus has stopped operating, realizes the empty state of sheets, and supplements sheets, thereby resuming the printing operation. In the conventional example, at the point corresponding to point D, the power supply has already been turned off. The possibility of resuming printing without erasing information stored in the memory is greatly increased.

In this embodiment, the copying machine having the power supply off mode is described by way of illustration, the invention is by no means limited to this, and is also applicable to the case in which the display of the operation panel is returned to its initial state such as auto clear function.

As in the foregoing, in this embodiment, the remaining number of sheets in paper feeding cassettes detected by stored sheet state detection sensors and the number of necessary sheets to output a job calculated by CPU 303 are compared by CPU 304. If the remaining number of sheets is smaller than the necessary number of sheets, the output interval for sheets is prolonged by CPU 304. As a result, the speed of outputting sheets is lowered.

Therefore, if a paper empty state will be attained because the remaining number of sheets is smaller than the necessary number of sheets, the output speed is lowered in response to the detection of a near empty state, and the occurrence of the paper empty state is delayed. Therefore, the possibility of the operator returning before the occurrence of the paper empty and supplementing sheets to prevent the occurrence can be increased. More specifically, a copying machine capable of sequentially and automatically outputting all the read documents can be provided.

Another example of near empty detection will be now described.

FIG. 41 shows a variation of the near empty detection processing shown in FIG. 37, with the difference being that step S805*b* is added to the processing shown in FIG. 37. More specifically, in the example shown in FIG. 41, if the number of necessary sheets for a job is smaller than the remaining number of sheets in the cassettes, in other words, there is no possibility of a shortage of sheets (YES in S804*b*), it is determined if a job is registered in code memory 356 other than the job presently being printed. If the remaining number of sheets in the cassettes exceeds the necessary number of sheets for the present job, there might be a shortage of sheets by a printing operation for a job registered other than the job presently being printed (YES in S805*b*), and therefore the output interval extension request flag is set to 1 (S808*b*), and the output interval is prolonged. Then the process returns. Note that if a job is registered in code memory 356 other than the job being printed, the operator may be alarmed by the indication on liquid crystal touch panel 91 rather than prolonging the output interval as described above. It is understood that the processing of increasing the output interval together with such indication is further advantageous.

FIG. 42 shows another example of the near empty detection processing shown in FIG. 41. Herein, the difference between FIGS. 42 and 41 is that instead of the calculating of the necessary number of sheets in S802*b* and the comparison between the necessary number of sheets and the remaining number of sheets in S804*b*, it is determined if the remaining number of sheets in the paper feeding cassette is larger than a prescribed number (SB03*c*).

If it is determined that the remaining number of sheets in the paper feeding cassettes detected by the stored sheet state detection sensors is smaller than the prescribed number, the control of increasing the output interval of sheets is performed. As a result, the speed of outputting the sheets is lowered.

If the remaining number of sheets is smaller than the prescribed number, the output speed is lowered in response to the detection of a near empty state, and the possible occurrence of a paper empty state will be delayed. As a result, without calculating the necessary number of sheets to output a certain job, the timing of occurrence of the paper empty state may be readily delayed simply based on the remaining number of sheets detected by the stored sheet state detector sensors and the remaining number of sheets.

If the stop state continues for a prescribed time period, CPU 304 controls the power control processing unit to turn off the power supply of the apparatus.

As in the foregoing, the occurrence of a paper empty state is delayed, and therefore the possibility of the operator returning to supply sheets to avoid a job stored in the memory from being destroyed can be increased as much as possible.

Although the present invention has been described and illustrated in detail, it is clearly understood that the same is by way of illustration and example only and.is not to be taken by way of limitation, the spirit and scope of the present invention being limited only by the terms of the appended claims.

What is claimed is:

1. An image forming apparatus, comprising:

an output portion for outputting a sheet on which an image is formed by executing a job;

a detector for detecting the remaining number of stored sheets;

a calculator for calculating the necessary number of sheets until output of a job is completed;

a comparator for comparing said necessary number of sheets calculated by said calculator and said remaining number of sheets detected by said detector;

a controller for delaying the speed to output sheets by said output portion if said remaining number of sheets is determined smaller than said necessary number of sheets.

2. The image forming apparatus as recited in claim 1, wherein said controller delays the output speed by increasing the interval of feeding of sheets by said output portion.

3. An image forming apparatus, comprising:

a memory for storing document image information;

a printing unit for forming and outputting an image onto a sheet based on the image information stored in said memory;

a calculation unit for calculating the necessary number of sheets based on the number of documents and the number of printing for each document; and a detector for detecting the remaining number of stored sheets, wherein if the number of sheets calculated by the calculation unit is larger than the remaining number of sheets detected by the detector, a warning is issued and the operation of outputting sheets is delayed.

4. The image forming apparatus as recited in claim 3, further comprising a power supply cut-off portion for cutting off power supply if an image forming operation is stopped for a prescribed time period.

5. The image forming apparatus as recited in claim 3, further comprising a plurality of sheet storing portions, wherein said detector detects the sum of the remaining numbers of sheets stored in said plurality of storing portions if sheets of the same size are stored in said plurality of storing portions.

6. A method of forming an image, comprising the steps of:

storing document image information;

forming an image on a sheet for printing based on said document image information;

calculating the necessary number of sheets based on the number of documents and the number of printing;

detecting the remaining number of stored sheets; and issuing a warning if the calculated number of sheets is larger than the remaining number of sheets and delaying outputting of a sheet.

7. The method as recited in claims 6, further comprising the step of cutting off power supply if an image formation operation is stopped for a prescribed time period.

* * * * *

UNITED STATES PATENT AND TRADEMARK OFFICE

CERTIFICATE OF CORRECTION

PATENT NO. : 5,966,555

DATED : October 12, 1999

INVENTOR(S) : Nakajima et al.

It is certified that error appears in the above-identified patent and that said Letters Patent is hereby corrected as shown below:

On the cover page:

In the "Inventors" section, delete all inventor information, and insert:

--Keiji Kusumoto, Toyokawa, Japan--.

Signed and Sealed this

Fifteenth Day of August, 2000

*Attest:*

Q. TODD DICKINSON

*Attesting Officer*

*Director of Patents and Trademarks*